US006479207B1

(12) United States Patent
Mori

(10) Patent No.: US 6,479,207 B1
(45) Date of Patent: Nov. 12, 2002

(54) PRINTING PLATE ELEMENT AND PRODUCTION METHOD THEREOF

(75) Inventor: Takahiro Mori, Hino (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/552,178

(22) Filed: Apr. 18, 2000

(30) Foreign Application Priority Data

Apr. 22, 1999 (JP) ..... 11-114816

(51) Int. Cl.[7] ..... G03C 1/73

(52) U.S. Cl. ..... 430/138; 430/46; 430/84; 430/133; 430/270.1

(58) Field of Search ..... 430/46, 84, 133, 430/138, 199, 270.1, 300

(56) References Cited

U.S. PATENT DOCUMENTS

| | | | | | |
|---|---|---|---|---|---|
| 5,340,676 | A | * | 8/1994 | Anderson et al. | 430/63 |
| 5,484,694 | A | * | 1/1996 | Lelental et al. | 430/530 |
| 5,731,119 | A | * | 3/1998 | Eichorst et al. | 430/63 |
| 6,004,710 | A | * | 12/1999 | Takagi et al. | 430/66 |
| 6,114,083 | A | * | 9/2000 | Kawamura et al. | 430/270.1 |
| 6,203,972 | B1 | * | 3/2001 | Katoh et al. | 430/619 |
| 6,214,458 | B1 | * | 4/2001 | Kobayashi et al. | 428/332 |
| 6,261,995 | B1 | * | 7/2001 | Nakajima et al. | 503/227 |
| 2001/0010892 | A1 | * | 8/2001 | Mori | 430/272.1 |
| 2002/0012881 | A1 | * | 1/2002 | Inno et al. | 430/303 |

FOREIGN PATENT DOCUMENTS

| | | | |
|---|---|---|---|
| JP | 363289937 | A * | 11/1988 |
| JP | 6-186750 | | 7/1994 |
| JP | 6-199064 | | 7/1994 |
| JP | 7-314934 | | 12/1995 |
| JP | 8-507727 | | 8/1996 |
| JP | 10-58636 | | 3/1998 |
| JP | 10-244773 | | 9/1998 |

OTHER PUBLICATIONS

Miall, L. M., ed. and Sharp, D.W.A., ed. A New Dictionary of Chemistry, Fourth Edition. London: Longman, 1968. 112–113, 309, 422.*

* cited by examiner

*Primary Examiner*—Janet Baxter
*Assistant Examiner*—Barbara Gilliam
(74) *Attorney, Agent, or Firm*—Frishauf, Holtz, Goodman & Chick, P.C.

(57) ABSTRACT

An image forming material having a support and a component layer is disclosed. In the image forming material the component layer contains a particle which comprises an organic particle core covered, with a material containing a light-heat conversion material. The image forming material is advantageously used for a printing plate or a laser thermal transfer recording material.

17 Claims, No Drawings

PRINTING PLATE ELEMENT AND PRODUCTION METHOD THEREOF

FIELD OF THE INVENTION

The invention relates to an image forming material by imagewise exposing the element to infrared laser and converting the laser light to heat and a production method of the element, particularly relates to improvement of the light-heat conversion material.

BACKGROUND OF THE INVENTION

Recently, a technology (CTP) has been noted accompanied with progress of semiconductor laser and digital image processing technology using a computer, in which a PS plate is by directly imagewise exposing to a light by scanning with a light beam emitted by a semiconductor laser according to image data prepared by a computer for making a planographic printing plate. Therefore, a CTP is required having a printing suitability equal to that of a PS plate which is low in price and easy for handling. Various CTP systems utilizing infrared laser recording are proposed recently. Among them, a CTP so called dry CTP is noted, which does not require any specific developing process. The dry CTP includes a CTP to be developed on printing machine. Examples of such the technology include the followings.

Japanese Patent Publication Open to Public Inspection (JP O.P.I.) No. 8-507727 discloses an image forming element and a method. The element is a heat mode recording element which comprises a substrate having on it an ink acceptable surface, anda recording layer containing a light-heat conversion material and a layer having a hardened hydrophilic surface and containing a light-heat conversion material each coated on the substrate. The recording layer and the layer provided at the upper side of the recording layer are removed by ablation by a laser to form an image.

JP O.P.I. No. 6-186750 discloses a method and an apparatus to form an image, in which a plate having a first layer and a second layer different from each other in the affinity to an ink or an ink adhesion preventing liquid is scanned by an infrared laser to ablate one or more of the layers for forming an image.

JP O.P.I. No. 6-199064 discloses a laser recording planographic printing plate element for forming an image by ablation which comprises a substrate having thereon an upper first layer absorbing infrared rays and a lower second layer, or an upper first layer and a lower second layer absorbing infrared rays, and the first and second layers are different from each other in the affinity to ink or ink adhesion preventing liquid.

JP O.P.I. No. 7-314934 discloses a laser recording printing element and a method for forming an image by ablation. The element comprises a not ablative most upper layer, an ablative thin metal layer of titanium or a titanium alloy and a substrate, and the most upper layer and the substrate are different from each other in the affinity to ink or ink adhesion preventing liquid.

JP O.P.I. No. 10-58636 discloses a planographic printing plate comprising a substrate having thereon a laser reactive hydrophilic swellable layer (preferably containing a colored pigment or black dye). The hydrophilic swellable layer is ablated by exposing to a laser light beam to form a inky image.

In the heat mode laser recording printing plate element including the above-mentioned ones, the unevenness of the dispersion of the light-heat conversion material in the layer some times causes a problem that causes lowering in the sensitivity or resolution ability. Particularly, a metal oxide having an electric conductivity such as titanium black is difficultly dispersed in the coating liquid and easily make an aggregate so as to tend to cause lowering in the sensitivity and resolution ability since such the substance.

It is usual in the above-mentioned methods that any layer provided on the substrate has a light-heat conversion ability and the layer having the light-heat conversion ability is formed by coating a layer in which a light-heat conversion material is mixed and/or dispersed. The amount and the dispersion degree of the light-heat conversion material in the layer are closely related to the sensitivity to the laser light. When an infrared absorbing dye soluble in the solvent of the coating liquid for forming the layer is used as the light-heat conversion material, the cost of the plate is raised since the infrared absorbing dye is very expensive although the dispersibility is good and the sensitivity is high concerning the amount thereof. Moreover, a wetting solution is difficultly applied to the printing plate since the water resistivity of the coated layer is lowered, when a water-soluble dye is added into an aqueous layer.

When a light-heat conversion material is in a form of solid fine particle, a relatively large adding amount thereof is required if the dispersion degree of it is low. Such the matter causes problems such that the cost is raised, the Resolution ability is lowered even though a sufficient sensitivity can be obtained, and the physical property of the coated layer is lowered and sufficient strength for printing plate cannot be obtained.

An electroconductive metal oxide is preferred as the material for using the printing plate according to the various properties thereof among the solid fine particle light-heat conversion substances. However, the material such as titanium black is very difficultly dispersed in the coating liquid and a method for improving the dispersing degree is demanded.

JP O.P.I. No. 10-244773 proposes as one of such the countermeasure that particles having a diameter of from 0.1 $\mu$m to 2.0 $\mu$m account for 50% or more of the total amount of titanium black dispersed in the layer having the light-heat conversion ability. The actual method for attaining to such the dispersed condition is a usual way by which the particles are kneaded by three rollers or a kneader before the dispersion using beads. Therefore, raising in cost in the dispersion process cannot be exempted. Moreover, the conversion efficiency of light to heat is not sufficiently improved since the titanium black having a primary particle diameter of several decades nanometer is used in a particle size of from 0.1 to 2.0 $\mu$m.

The printing plate element for forming an image without ablation of the layer having the light-heat conversion ability has a large advantage that the laser head is not contaminated even when any protection is not provided to the exposing device since the ablated substance is not scattered at the time of exposing to laser light. However, the layer near the light-heat conversion particle is locally ablated since heat is only locally generated and the temperature of the whole layer is not be raised when the light-heat conversion material having a diameter of about 2 $\mu$m is contained in the light-heat conversion layer of the printing plate having such the constitution. Accordingly, the sensitivity of the layer is lowered.

Furthermore, the surface of the printing plate formed by the coated layer tends to be insufficient in the strength, and a damage by scratching is frequently raised as a problem since it causes a contamination of the printed image.

Furthermore, the image forming element in which image-wise irradiated infrared laser light is converted to heat by a light-heat conversion material to form an image, other than the foregoing planographic plate element, has had problems of lowering in the sensitivity and the resolution ability and occurring of ablation caused by local heat generation. Such the problems caused by uneveness of dispersion of the light-heat conversion material.

SUMMARY OF THE INVENTION

The object of the invention is to provide an image forming material such as a printing plate, laser thermal transfer recording material, capable of being recorded by a heat mode recording, which has a high sensitivity, high resolution ability and a high abrasion resistivity, and contamination caused by scratch is difficultly formed, and producing method thereof.

The constituent of the invention for attaining the above-mentioned object is followings.

1. An image forming material comprising a support, and a component layer, wherein the component layer contains a particle comprising a core covered with a material containing a light-heat conversion material.
2. The image forming material wherein the image forming material is a printing plate material.
3. The image forming material wherein the image forming material is a laser thermal transfer recording material comprising a light-heat conversion layer and an ink layer.
4. The image forming material wherein the image forming material comprises an image forming layer other than the component layer.
5. The image forming material wherein the component layer is an image forming layer.
6. The image forming material wherein the light-heat conversion material is electroconductive.
7. The image forming material wherein the light-heat conversion material is a metal oxide.
8. The image forming material wherein the light-heat conversion material is titanium oxide nitride.
9. The image forming material wherein the core is an organic particle.
10. The image forming material wherein transmittance of infrared rays at wavelength of 830 nm of the core is 90 to 100% per 1 $\mu$m of the core.
11. The image forming material wherein the average diameter of the core is 0.1 to 19 $\mu$m.
12. The image forming material wherein the coverage ratio of the material containing a light-heat conversion material on the core is not less than 20% by area.
13. A light-heat conversion particle comprising a core, a material containing light-heat conversion material, wherein the core is covered with the material containing light-heat conversion material.
14. The light-heat conversion particle wherein the light-heat conversion material is electroconductive.
15. The light-heat conversion particle wherein the light-heat conversion material is a metal oxide.
16. The light-heat conversion particle wherein the light-heat conversion material is titanium oxide nitride.
17. The light-heat conversion particle wherein the core is an organic particle.
18. The light-heat conversion particle wherein the coverage ratio of the material containing a light-heat conversion material on the core is not less than 20% by area.
19. A method of preparing image forming material comprising step of providing a component layer by coating a coating composition, wherein the coating composition contains a particle which comprises a core covered with a material containing light-heat conversion material, wherein surface of the core is covered with the material containing the light-heat conversion material by means of dry dispersion or spray dispersion method. The preferable embodiments of the invention are described.

(1) A printing plate element comprising a substrate having thereon a layer containing a particle (A) comprising a core covered with a material containing a light-heat conversion material.

(2) A printing plate element comprising a substrate having thereon a layer containing the particle (A) described in the above-mentioned (1) and a layer having an ability for forming an image by light or heat.

(3) The printing plate element described in (1) or (2) wherein the light-heat conversion material of the particle (A) is an electroconductive metal oxide.

(4) The printing plate element described in (1), (2) or (3) wherein the core of the particle (A) is an organic particle.

(5) The printing plate element described in any one of (1) to (4) wherein the average diameter of the particle (A) is within the range of from 0.1 to 10 W.

(6) The printing plate element described in any one of (1) to (5) wherein the coverage ratio of the material containing a light-heat conversion material on the particle (A) is not less than 20%.

(7) A method for producing a printing plate element comprising the step of coating on a substrate a liquid containing a particle (A) covered with a material containing a light-heat conversion material wherein the particle (A) is covered by a dry dispersion process or a spray drying process.

It is found by the inventors that a very high light-heat conversion efficiency concerning to the amount of light-heat conversion material in the layer can be obtained by adding particles each comprised of a core covered with a thin layer of a light-heat conversion material to the layer having a light-heat conversion ability. Moreover, it is confirmed that no ablation is occurred when such the layer having the light-heat conversion ability is used in a printing plate element in which an image is formed without ablation of the layer having the light-heat conversion ability. It is also found regarding such the problem that the scratch can be prevented while maintaining the high sensitivity by adding the particle having the core with a relative high hardness or strength into the layer in a high density. It is further found that the scratch preventing effect can be further raised when an organic particle covered with the electroconductive metal oxide is added since such the particle has a high surface hardness and strength.

DETAILED DESCRIPTION OF THE INVENTION

The invention is described in detail below.

First, the particle (A) comprising a core covered with a material containing a light-heat conversion material, and the layer containing the particle (A) are described.

In the invention, the following inorganic or organic particle can be used as the core particle of the particle (A). Two or more kind of particle each comprised of different kind of material may be used.

Content of the core particle is preferably 15 to 85 wt % of light-heat conversion layer. The core particle preferably has transmittance of infrared ray at wavelength of 830 nm of 90 to 100% per 1 μm core thickness.

Particle of a usual metal oxide such as silica, alumina, aluminum silicate, titania and zirconia may be used as the inorganic core particle. A porous particle having an appearance specific gravity of not more than 1.5 is preferable since a particle having a high specific gravity causes the problem of sedimentation when the particle is dispersed in the liquid. Besides, when the porosity is too high, the strength of the particle is lowered and the abrasion resistivity is degraded. Accordingly, it is preferable that the oil absorbing amount of the particle is within the range of from 40 ml to 100 ml per 100 g. The shape of the particle preferably nears sphere. Examples of such the porous particle include a porous silica particle and a porous aluminum silicate particle.

Particle of usual cross-linked resin such as Nylon, PMMA, silicone, Teflon, polyethylene and polystyrene may be used as the organic particle. Particle of calcium alginate is also usable. When an organic core is used, the particle (A) comprised of the covered core may be prepared by a method so-called a microcapsule forming method.

The above-mentioned particle may be used after a surface treatment with a coupling agent, a sol such as an iron sol or a tin sol, or a known surface treatment agent even though the particle is usable without the treatment. The average particle diameter is preferably from 0.1 to 19 μm, more preferably from 0.5 to 6 μm, in the diameter of primary particle. Two or more kinds of particle different in the average diameter from each other may be employed in combination.

In the invention, the light-heat conversion material is a substance capable of conversion light to heat. In the image forming material such as a printing plate, laser thermal transfer recording material, of the invention, an image is recorded by infrared rays. Accordingly, the light-heat conversion material having an ability to convert infrared rays to heat, namely a material having an absorption in infrared region, can be used in the particle (A). Example of such the material, a usual infrared absorbing dye such as a cyanine dye and a phthalocyanine dye. However, the addition of a water-soluble dye is added into the porous layer causes lowering the water resistivity and durability of the layer. Moreover, when the water-insoluble dye is added, it is difficult to uniformly disperse the solid dye into a form of extreme fine particle, and the light-heat conversion efficiency of the dye in an aggregated state is low and such the dye causes contamination during the image forming or printing process. However, the core particle can be covered by such the dyes, for example, by a method in which the dye is dissolved or dispersed in a solvent together with a suitable binder and adhered on the core particle by the later-mentioned spray drying method.

Content of the light-heat conversion material is preferably 0.5 to 30 wt %, more preferably 1 to 15 wt % of the light-heat conversion layer.

Among the light-heat conversion materials having an absorption in infrared region, ones each having an electroconductivity it self is preferable. The light-heat conversion material may be a semiconductor. When the light-heat conversion material has an electroconductivity the adhesiveness of ink at the non image area is considerably improved and the recovering ability of contamination is greatly improved in the printing material using a moisturizing liquid, even though the reason of such the phenomenon is not appear. Examples of such the substance include a metal, electroconductive carbon, graphite and an electroconductive metal oxide. Among them, the electroconductive metal oxide is particularly preferred.

Any metal can be used as long as the metal can be in a form of fine particle having a diameter of from not more than 0.5 μm, preferably not more than 100 nm, more preferably not more than 50 nm. The shape of the particle may be any of spheres, shard-like and needle-like. A colloidal particle of metal such as silver and gold is particularly preferred.

The use of furnace black or acetylene black is particularly preferable as the electroconductive carbon. The graininess ($d_{50}$) of it is preferably not more than 100 nm, more preferably not more than 50 nm. The electroconductivity parameter represented by the following equation is preferably a not less than 30, more preferably not less than 50.

$$\text{Electroconductivity parameter}=(\text{Specific surface area } (m^2/g)\times\text{DBP oil-absorption amount } (ml/100\ g))^{1/2}/(1+\text{Volatile ingredient})$$

In the case of graphite, the fine particle having a particle diameter of not more than 0.5 μm, preferably not more than 100 nm, more preferably not more than 50 nm is usable.

The surface of the core particle can be covered with the fine particle of metal or carbon by a spray drying method.

Examples of the electroconductive or semiconductive metal oxide include ZnO, ZnO doped with Al, $SnO_2$, $SnO_2$ doped with Sb (ATO), $In_2O_3$ added with Sn (ATO), $TiO_2$, and TiO prepared by reduction of $TiO_2$ (titanium oxide nitride, generally titanium black). Ones comprised of a core material such as $BaSO_4$, $TiO_2$, $9AlO_32B_2O_3$, and $K_2O_nTiO_2$ covered with such the metal oxide are also usable. The diameter of the particle is not more than 0.5 μm, preferably not more than 100 nm, more preferably not more than 50 nm. These metal oxides can be fixed and or adhered on the core particle surface by physical digging by a dry method or by electrostatic adhesion force, even though also can be adhered by the spray drying method.

When the light-heat conversion layer is utilized as the hydrophilic layer of non-image area of the printing plate using moisturizing liquid, it is particularly preferable to use the electroconductive metal oxide as the light-heat conversion material. The polar component in the hydrophilic layer is increased by the addition of the metal oxide, and the phydrophilicity of the layer is raised.

In the invention, two or more kinds of light-heat conversion material may be used, and the light-heat conversion material may be added in the binder of the layer in addition to the use for covering the core particle.

In the invention, the material containing the light-heat conversion material (hereinafter referred to "covering material") means the light-heat conversion material it self or a mixture of the light-heat conversion material and another covering material, for example a binder and an additive.

In the invention, the surface of the core material can be covered with the material containing the light-heat conversion material by applying the method for preparing a microcapsule. For example, the methods described in T. Kondo and M. Koishi "microcapsule; Preparation method, Properties and Application thereof", 1985, Sankyo Shuppan, and the publications referred in the publication are applicable, however the method is not limited thereto. Among them, the following methods are suitable.

Spray Drying Method

A dispersion liquid of the light-heat conversion material to be used is prepared. The binder and the solvent may be optionally decided. Usual kneading and dispersion methods can be applied. These methods each have an advantage such that the dispersing process can be carried out with a high efficiency since the material for covering is only dispersed and the binder and the solvent other than those to be used in the layer can be used. For example, the covered particle to be added into a solvent system coating liquid is prepared in an aqueous system. The core particles are uniformly suspended in this dispersion and the suspension is sprayed and dried to obtain the covered particles. This process can be carried out by the use of usual spray dry granule preparation apparatus. The concentration of the light-heat substance dispersion is preferably from 0.1 to 10% by weight and the concentration of the core particle suspension is preferably from 10 to 50% by weight.

Dry Dispersion Method

By this method, the core particle is collided with the covering material to fix the covering material onto the core particle surface by a static electricity force or a physical digging. In this method, it is preferable that the core particle is not crushed by the physical impact, and the method is particularly suitable when an organic particle such as Nylon, PMMA, silicone and Teflon, is used as the core particle.

The covering can be carried out, for example, by using a dispersing apparatus such as a sand grinder and a ball mill. An apparatus such as Hybridizer, manufactured by Nara Kikai Seisakusyo Co., Ltd., utilizing an impact giving method in high speed air flow without using beads is preferably applied since the covered particle can be easily recovered. When dispersing beads (glass or ceramic) are used, the covering treatment is carried out at a rotating speed of from 300 to 2000 r.p.m. for a time of from 5 to 60 minutes. When Hybridizer is used, the treatment is performed at a circumference speed of from 50 to 150 m/sec. for a time of from 1 to 20 minutes.

In the invention, covering ratio of the covering material including the light-heat conversion material and another binder and additive if they are used, is preferably not less than 20% in area. The covering ratio is a ratio of the area covered with the covering material to the surface area of the core particle calculated regarding as a sphere. The weight ratio of the covering material to the whole weight of the covered particle, or the particle (A), is preferably from 5 100, more preferably from 10 to 60%.

In the dry method, the covering ratio is preferably not less than 50% in average, more preferably not less than 80%. The amount of the light-heat conversion material is preferably from 1 to 50%, more preferably from 5 to 20%, by weight.

It may be designed so that the mixture of the light-heat conversion material and a binder covers the core particle. Preferable example of the binder is the same as the example of a binder employed in the light-heat conversion layer mentioned later.

In the invention, the light-heat conversion material may be added in the binder in addition to that contained in the form of the particle (A) covered with the light-heat conversion material. In such the case, it is preferable that the dispersion degree of the light-heat conversion material is higher.

A known organic, inorganic or organic-inorganic complex binder can be used as the binder component of the layer containing the particle (A) or the light-heat conversion layer, and the suitable binder is different depending on the type of image forming material orprinting plate (using or not using a moisturizing liquid) or the layer constitution of the printing plate. Preferable example of the binder is described below. Metal oxide fine particles having average particle diameter of less 100 nm is also employed. An organic hydrophilic binder is also preferably employed. The examples are; polyvinyl alcohol, silyl modified polyvinyl alcohol, cation-modified polyvinyl alcohol, cellulose derivatives such as methyl cellulose, carboxy methyl cellulose and hydroxy ethylcellulose, polyethylene oxide, polypropylene oxide, polyethylene glycol, polyvinyl ether, conjugate diene polymer latex such as styrene-butadiene copolymer and methylmethacrylate-butadiene copolymer, acryl polymer latex, vinyl polymer latex, polyacrylamide and polyvinylpyrrolidone.

Hydrophilic layer may contain also cationic resin. Example of the cationic resin include polyalkyleneamine such as polyethyleneamine and polypropylenepolyamine, or derivative thereof, acryl resin containing tertiary amine group or quaternary ammonium group and diacryl amine.

The cationic resin may e added in a form of fine particle. Example thereof is cationic microgel disclosed in JP O.P.I. No. 6-161101.

cross-linking agent may also be added in the hydrophilic layer. Examples of the cross-linking agent include melamine resin, isocyanate compound, iso-oxazole compounds, aldehyde compounds, N-methylol compound, dioxane derivative, active vinyl compound, active halogen compound.

Binding agent of silicate may also be employed. Alkali metal silicate such as sodium silicate, potassium silicate and lithium silicate is preferable. The ratio of $SiO_2$ to metal am oxide is selected so that the pH of coating composition as a whole to which the silicate is added does not exceed 13.

Inorganic or organic-inorganic hybrid polymer by sol-gel method may be also employed. The methods, for example, those described in S. Sakka, "Application of Sol-Gel Method", Agune-Syofu Sha, and those described in the literatures referred in this publication are usable for producing the inorganic polymer or the organic-inorganic hybrid polymer.

The content of the particle (A) in the light-heat conversion layer is preferably from 20 to 90%, more preferably from 40 to 80%, by weight. The component layer is preferably has injure generating weight of not less than 20 g, and more preferably not less than 50 g, and further preferably 100 g. The injure generating weight is measured to find weight at which injure generates by sliding a sapphire needle having 0.1 mm diameter on the surface of the layer with generating weight continuously from 0 to 200g by employing abrasion test meter (HEIDON-18).

In another preferable embodiment of the printing plate element of the invention, the printing plate element has a layer having a function of forming an image by light or heat in addition to the layer containing the particle (A). Such the embodiment includes a printing plate element having a layer capable of forming an image by light or heat which comprises the particle (A) as the hydrophilic layer and a layer comprising an ink-acceptable fine particle which is thermally fused and adhered such as a wax emulsion. In such the plate, the particle layer is fused and adhered by imagewise heating and the particle layer at the non-fused area is removed to expose the hydrophilic layer for forming the printing surface. Besides, there is a method by which an ink-acceptable material is imagewise adhered by an ink-jet method to form an image layer on the surface of the layer containing the particle (A). A material capable of being hardened by light or heat is preferably used as the image forming material (ink) in such the ink-jet method. Moreover, there is a printing plate element to be used for forming an image by a thermal fusion transfer process.

The image forming material according to the invention may has an image forming layer other than the component layer containing the light-heat conversion particle of the invention (light-heat conversion layer), or the component layer containing the light-heat conversion particle of the invention (light-heat conversion layer) may combine the function of the image forming layer with the light-heat conversion function.

Thickness of the component layer containing the light-heat conversion particle is preferably 0.1 to 20 μm, more preferably 0.5 to 10 μm.

When the invention is applied to a photosensitive planographic plate using no moisturizing liquid, for example, a light-heat conversion layer containing the particle (A) of the invention is provided on the substrate and an ink-repelling layer containing silicone is provided on the light-heat conversion layer.

In the light-heat conversion layer, infrared light is absorbed and converted to heat, and the light-heat conversion layer is removed by ablation. Ablation of the ink-repelling layer is induced by the heat generated in the light-heat conversion layer.

An organic high molecular weight substance may be added to the light-heat conversion layer, in addition to the particle (A), for raising the coating property of the layer, the dispersion degree of the particle (A), the strength of the layer and the effect of ablation.

Examples of such the organic high molecular weight substance include a copolymer of an unsaturated acid such as (metha)acrylic acid and itaconic acid with an alkyl (metha)acrylate, phenyl (metha)acrylate, benzyl (metha) acrylate, styrene or a-methylstyrene; a polymer of an alkyl methacrylate or an alkyl acrylate such as poly(methyl methacrylate); a copolymer of an alkyl (metha)acrylate and acrylonitril, vinyl chloride, vinylidene chloride or styrene; a modulated cellulose having a carboxyl group at the side chain thereof; poly(ethylene oxide), polyvinylpyrrolidone; a novolak resin produced by a condensation reaction of phenol, o-, m-, p-cresol with aldehyde or acetone; a polyether of epichlorohydrin and bisphenol A; soluble Nylon; poly(vinylidene chloride); chlorinated polyolefin; a copolymer of vinyl chloride and vinyl acetate; poly(vinyl acetate); a copolymer of acrylonitril and styrene; a copolymer of acrylonitril, butadiene and styrene; a poly(vinyl alkyl ether); a poly(vinyl alkyl ketone); polystyrene; polyurethane; poly (styrene terephthalate-isophthalate); acetyl cellulose; acetyl propoxy cellulose; acetyl butoxy cellulose; nitrocellulose; celluloid; and poly(vinyl butyral). The content of the organic high molecular weight substance in the light-heat conversion layer is from 1 to 60%, preferably from 2 to 50%, more preferably 2 to 40%, by weight of the total weight of solid components of whole photosensitive layer.

Among the above organic high molecular weight substances, nitrocellulose is preferably contained in the light-heat conversion layer since the efficiency of ablation is raised by gas generated by the decomposition of nitrocelluloseat the time of exposing.

The silicone rubber layer usable in the invention may be optionally selected from known ones such as those disclosed in JP O.P.I. No. 7-164773. A condensation cross-linking type silicone rubber by which the silicone rubber layer composition is hardened by a condensation reaction, and an addition cross-linking type silicone rubber by which the silicone rubber layer composition is hardened by an addition reaction, are preferably used.

The condensation cross-linking type silicone rubber layer usable in the invention contains, as essential components, a linear organopolysiloxane having a hydroxyl group at each of the both terminals and a reactive silane compound capable of forming a silicone rubber layer by cross-linking with the linear organopolysiloxane. Examples of the linear organopolysiloxane having a hydroxyl group at each of the both terminals include a linear organopolysiloxane represented by the following Formula 1.

(1)

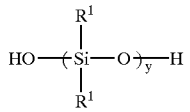

In the formula, two of $R^1$ are each independently a hydrogen atom, a methyl group, a phenyl group or a vinyl group, and y is an integer of 1 or more. Among the compounds represented by Formula 1, ones in which $R^1$ is a methyl group is preferred. The weight average molecular weight (hereinafter referred to Mw) of the organo-siloxane is from 5,000 to 1,000,000, preferably from 10,000 to 1,000,000. When the Mw is too low, the printing durability is degraded since the strength of layer is lowered, and the Mw is too high, degradation in the sensitivity and image reproducibility is caused since the removing efficiency of the silicone rubber by ablation is lowered.

The reactive silane compound usable in the invention is a reactive silane compound having a molecular weight of not more than 2,000 and at least 2 functional groups capable of cross-linking by a condensation reaction such as a deacetyl type, deoxime type, dealcohol type, deamino type or dehyration type reaction, with the linear-organopolysiloxane having a hydroxyl group at each of the both terminals. Concrete examples of the functional group include those represented by the following formulas.

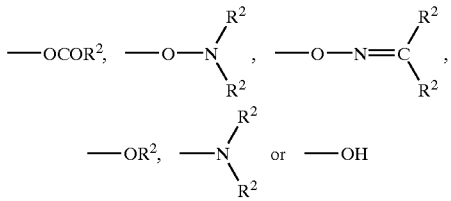

In the formulas, $R^2$ is an alkyl group having from 1 to 5 carbon atoms, when two $R^2$ are in the same group of atoms, they may be the same or different. Among them, ones in which the functional group is an acyloxy group (—$OCOR^2$) and the number thereof is three or more, and ones in which the functional group is an alkoxyl group (—$OCOR^2$) and the number thereof is three or more, are preferable since the silicone rubber layer can be formed in a shorten time after coating and drying of the layer. Ones having three or more acetoxy groups and ones having six or more alkoxyl groups are further preferable.

Examples of the reactive silane compound include the compounds represented by the following Formulas 2 to 5. In the formulas, Q is the functional group capable of reacting with the linear organopolysiloxane having a hydroxyl group at each of both terminal, and at least two Q are in the molecular.

(2)

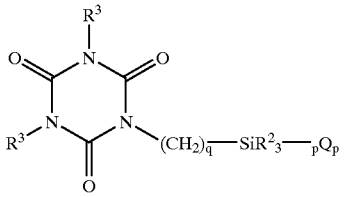

-continued (3)

$$X_{3-r}—N\left[(CH_2)_q—Si—R^2_{3-p}Q_p\right]_r$$

(4)

$$X_{4-s}—Si—Q_s$$

(5)

$$Q_pR^2_{3-p}Si—(CH_2)_t—W—(CH_2)_u—SiR^2_{3-p}Q_p$$

In the formula, X is an alkyl group having 1 to 5 carbon atoms, a phenyl group, a vinyl group, a $H_2N—(CH_2)_h—$ group, a $CH_2=C(CH_3)CO—$ group, a $CH_2=CHCO—$ group,

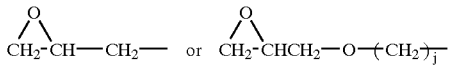

W is an oxygen atom, a sulfur atom, an —SSSS— group, an alkylene group having 1 to 10 carbon atoms or an $—N(R^4)—(CH_2)_q—N(R^4)—$ group, $R^2$ is an alkyl group having 1 to 5 carbon atoms, $R^3$ is an aryl group or a $—(CH_2)_q—SiR^2_{3-p}Q_p$ group, $R^4$ is a hydrogen atom, an alkyl group having 1 to 5 carbon atoms or a phenyl group, when plural of $R^2$, $R^3$ or $R^4$ are in the same molecular, the groups each represented by $R^2$, $R^3$ or $R^4$ may be the same or different, h, j and q are each an integer of from 1 to 5, p and r are each an integer of from 1 to 3, s is an integer of from 2 to 4, and t and u are each an integer of from 1 to 5. Concrete examples of the silane compound usable in the invention are shown below, however the compound is not limited thereto.

Si1

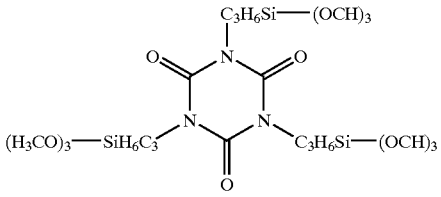

Si2

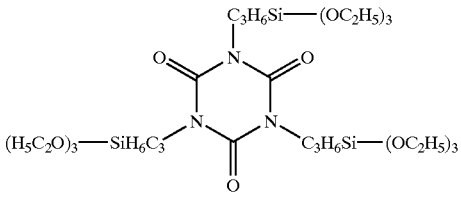

Si3

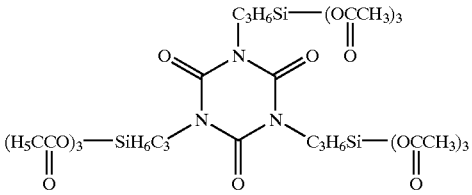

Si4

$$H_2N—\left[(CH_2)_3—Si—(OCH_3)_3\right]_2$$

Si5

$$H_2NC_2H_4N—\left[(CH_2)_3—Si—(OCH_3)_3\right]_2$$

Si6

$$CH_2=CHCN—\left[(CH_2)_3—Si—(OCH_3)_3\right]_2$$

-continued

Si7

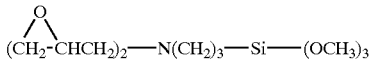

Si8

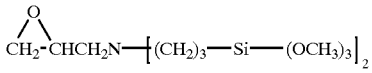

Si9

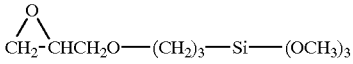

Si10

$$Si—(OCH_3)_4$$

Si11

$$H_3C—Si—(OCH_3)_3$$

Si12

$$H_5C_2—Si—(OC_2H_5)_3$$

Si13

$$H_5C_2—Si—(OC_2H_5)_3$$

Si14

$$H_2C=CH—Si—(OCH_3)_3$$

Si15

$$(H_3CO)_3—Si—(CH_2)_2—Si—(OCH_3)_3$$

Si16

$$(H_3CO)_3—Si—(CH_2)_6—Si—(OCH_3)_3$$

Si17

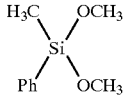

Si18

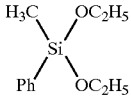

Si19

$$(H_5C_2O)_3—Si—(CH_2)_2—Si—(OC_2H_5)_3$$

Si20

$$(H_3COCO)_3—Si—(CH_2)_2—Si—(OCOCH_3)_3$$

Si21

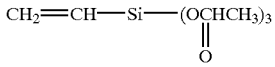

Si22

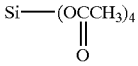

Si23

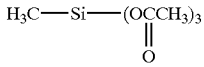

Si24

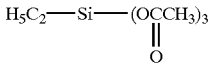

Si25

$$(H_3CO)_3—Si—(CH_2)_3—NH—C_2H_4—NH—(CH_2)_3—Si—(OCH_3)_3$$

Si26

$$(H_5C_2O)_3—Si—(CH_2)_3—SSSS—(CH_2)_3—Si—(OC_2H_5)_3$$

Si27

Methyltris(acetoxime)silane

Si28

Vinyltir(methylethylketoxime)silane

Si29

Methyltri(methylethylketoxime)silane

Si30

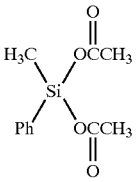

The condensation cross-linking type silicone rubber layer to be used in the invention is hardened by the condensation reaction in the presence of an optional condensation catalyst such as an organic carboxylic acid, a titanate ester, a stannous ester, an aluminum organic ester and a platinum catalyst for raising the reaction efficiency of the reactive silane compound with the linear organopolysiloxane having a hydroxyl group at each of the both terminals.

In the invention, the ratio of the linear organopolysiloxane having a hydroxyl group at each of the both terminals, the reactive silane compound and the condensation catalyst in the silicone rubber layer is 80 to 98%, preferably from 85 to 98%, by weight of the linear organopolysiloxane having a hydroxyl group at each of the both terminals, usually from 2 to 20%, preferably from 2 to 15%, more preferably from 2 to 7%, by weight of the reactive silane compound and from 0.05 to 5%, preferably from 0.1 to 3, more preferably from 0.1 to 1%, by weight.

When the ratio of the reactive silane compound or the condensation catalyst is too high, the ink-repelling ability is lowered and the silicone rubber layer is difficultly removed by the ablation. As a result of that, the sensitivity and the image reproducibility are lowered. In contrast, when the ratio is too low, the printing durability is degraded since the strength of the silicone rubber layer is lowered.

In the silicone rubber layer to be used in the invention, a polysiloxane compound other than the linear organopolysiloxane having a hydroxyl group at each of the both terminals may be added in a ratio of from 2 to 15%, preferably 3 to 12%, by weight of the whole weight of the solid components of the silicone rubber layer to raise the ink-repelling ability of the silicone rubber layer. Example of such the siloxane compound includes a polydimethylsiloxane having a trimethylsilyl group at each of the both terminals and a Mw of from 10,000 to 1,000,000.

The addition cross-linking type silicone rubber layer to be used in the invention contains, as the essential components, an organopolysiloxane compound having at least two aliphatic unsaturated groups in the molecular thereof and an organopolysiloxane compound having at least two Si—H bonds in the molecular thereof which is cross-linked with the organopolysiloxane compound having at least two aliphatic unsaturated groups in the molecular thereof to form the silicone rubber layer.

The organopolysiloxane compound having at least two aliphatic unsaturated groups in the molecular thereof may have any structure of linear, cyclic or branched, and ones having the linear structure are preferred. Examples of the aliphatic unsaturated group include an alkenyl group such as a vinyl group, an aryl group, a butenyl group, a pentenyl group, a hexenyl group; a cycloalkenyl group such as a cyclopentenyl group, a cyclohexenyl group, a cycloheptenyl group and a cyclooctenyl group,; and an alkynyl group such as an ethynyl group, a propynyl group, a butynyl group, a pentynyl group and a hexynyl group. Among them, an alkenyl group having an unsaturated bond at the terminal is preferable from the viewpoint of the reactivity, and a vinyl group is particularly preferable. The substituent other than the aliphatic unsaturated group is preferably a methyl group for obtaining a high ink-repelling ability.

Mw of the organopolysiloxane having at least two aliphatic unsaturated groups in the molecule thereof is usually from500 to 500,000, preferably from 1,000 to 300,000. When Mw is too low, the strength of the silicone rubber layer is lowered and the silicone rubber layer tends to be damaged at the time of printing. As a result of that, the ink repelling ability of the silicone rubber layer is degraded at the damaged portion and the ink is easily adhered to such the portion, and the contamination on the printed image is caused. When the Mw is too high, lowering in the sensitivity and in the image reproducibility tends to be occurred since the removing the silicone layer by ablation becomes insufficient.

The organopolysiloxane compound having at least two Si—H bonds in the molecular thereof may have any structure of linear, cyclic or branched, and ones having the linear structure is preferred. The Si—H bond may be existed at either theterminal or intermediate portion of the siloxane skeleton, and the ratio of the hydrogen atom to the total A number of the substituent is usually from 1 to 60%, preferably from 2 to 50%. The substituent other than the hydrogen atom is preferably a methyl group for obtaining a high ink-repelling ability. The Mw of the organopolysiloxane compound having at least two Si—H bonds in the molecular thereof is usually from 300 to 300,000, preferably from 500 to 200,000. The Mw too high tends to cause lowering in the sensitivity and in the image reproducibility.

A addition reaction catalyst is usually used to occur the addition reaction of the organopolysiloxane compound having at least two aliphatic unsaturated groups in the molecular thereof with the organopolysiloxane compound having at least two Si—H bonds in the molecular thereof. The addition reaction catalyst can be optionally selected from known ones, and a platinum catalyst is preferably used. One or a mixture selected from metals of platinum group and compounds of metal of platinum group may be preferably used as the addition reaction catalyst. Examples of the metal of platinum group include elemental platinum such as platinum black, elemental palladium such as palladium black and elemental rhodium. Examples of the compound of metal of platinum group include chloroplatinic acid, a platino-olefin complex, a platino-alcohol complex, a platino-ketone complex, a complex of platinum and vinylsiloxane, platinum tetrakis(triphenyl-phosphine) and palladium tetrakis (triphenylphosphine). Among them, chloroplatinic acid or platino-olefin complex dissolved in an alcoholic solvent, an ether solvent or a carbon hydride solvent is particularly preferred.

The ratio of the components for forming the above-mentioned silicone rubber layer is 80 to 98%, preferably from 85 to 98%, by weight of the organopolysiloxane having at least two aliphatic unsaturated groups, usually from 2 to 20%, preferably from 2 to 15%, by weight of the organo-siloxane having at least two Si—H bonds in the molecular thereof and from 0.0001 to 10%, preferably from 0.0001 to 5%, by weight of the addition reaction catalyst.

When the content of the organo-siloxane having at least two Si—H bonds in the molecular thereof is too low, the strength of the silicone rubber layer is lowered and the ink-repelling ability and the printing durability are degraded. When the content of that is too high, the sensitivity and the image reproducibility are lowered. An amino containing organic silicon compound having a hydrolyzable group represented by the following Formula 6 may be added to the addition cross-linking type silicone rubber layer usable in the invention for raising the strength of the layer.

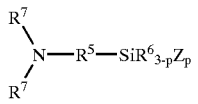

(6)

In the formula, Z is a hydorolyzable group, $R^5$ is a di-valent hydrocarbon group, $R^6$ is a mono-valent carbon hydride group which may have a substituent, two of $R^7$ are each independently a hydrogen atom, a mono-valent carbon hydride group which may have a substituent or a group represented by $—R^5—SiR^6_{3-p}Z_p$, and p is an integer from 1 to 3.

Examples of the hydrolyzable group include an alkoxy group such as a methoxy group, an ethoxy group and propoxy group; an alkenyloxy group such as a 2-propenyloxy group; an aryloxy group such as a phenoxy group; and an acyloxy group such as acetyloxy group. Among them, the methoxy group, ethoxy group and acetyloxy groups are preferred from the viewpoint of the stability and the hardening ability. Examples of the di-valent carbon hydride group include the followings.

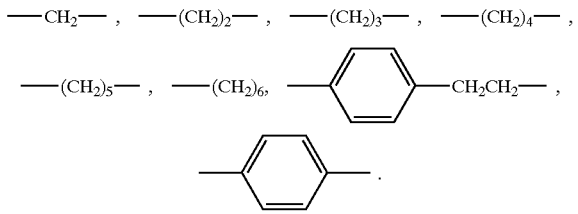

Among them, $—(CH_2)_3—$ is preferable. Examples of the mono-valent carbon hydride group represented by $R^6$ and $R^7$ which may have a substituent include an alkyl group such as a methyl group, an ethyl group, a propyl group and a butyl group; a cycloalkyl group such as a cyclopropyl group, a cyclobutyl group, a cyclopentyl group, a cyclohexyl group, a cycloheptyl group and a cyclooctyl group; an alkenyl group such as a vinyl group, an allyl group, a butenyl group, a pentenyl group and a hexenyl group; a cycloalkenyl group such as a cyclopentenyl group, a cyclohexenyl group, a cycloheptenyl group and a cyclooctenyl group; and a substituted alkyl group such as a glycidoxypropyl group, an acryloxypropyl group, a methacryloxypropyl group and an aminoethyl group. The groups represented by $R^6$ and $R^7$ are preferably a vinyl group, an allyl group, a glycidyl group, a methacryl group or a γ-glycidoxypropyl group from the viewpoint of the hardening ability.

Concrete examples of the amino containing silicon compound include 3-[N-allyl-N-(2-aminoethyl)]aminopropyltrimethoxysilane, 3-(N-allyl-N-glycidyl)aminopropyltrimethoxysilane, 3-(N-allyl-N-methacryl)aminopropyltrimethoxysilane, N-glycidyl-N,N-bis[3-(methyldimethoxysilyl)-propyl]amine, N-glycidyl -N,N-bis[3-trimethoxysilylpropyl]amine, aminopropyltrimethoxysilane, aminopropyltriacetyloxysilane, 3-[N-allyl-N-(2-aminoethyl)]aminopropyltriacetyloxysilane, 3-(N-allyl-N-glycidyl)aminopropyltriacetyloxysilane and 3-(N-allyl-N-methacryl)aminopropyltriacetyloxysilane. Two or more of these compounds may be used in combination.

The ratio of the amino-containing organic silicon compound to the whole solid components weight of the silicone rubber layer is from 0 to 10%, preferably from 0 to 5%, by weight. A hardening delaying agent may be added into the addition cross-linking silicone rubber layer to inhibit the suddenly hardening of the silicone composition at the time of coating the silicone rubber layer. The hardening delaying agent can be optionally selected from compounds known as the hardening delaying agent such as an acetylene alcohol, a maleic ester, a silylated compound of acetylene alcohol, a silylated compound of maleic acid, a triacyl isocyanulate and a vinylsiloxane.

The adding amount of the hardening delaying agent is usually from 0.0001 to 1.0 parts by weight of the whole solid components of the silicone rubber layer, even though the amount may be different according to the desired hardening speed. Inorganic filler such as silica, titanium oxide and aluminum oxide may be added into the above-mentioned condensation cross-linking type and addition cross-linking type silicone rubber layer to raise the strength thereof. Silica is particularly preferred. The filler having a diameter of not more than 500 μm is preferable from the view point of the dispersibility and the stability of dispersion.

The above-mentioned silicone rubber layers are excellent in the ink-repelling ability and printing durability, and are capable of being easily removed by ablation, and have a high sensitivity and high image reproducibility. The scratch resistivity of the silicone rubber layer is preferably within the range of from 10 to 100 g. The scratch resistivity is expressed by the load in gram necessary to form a scratch when the layer is moved with a speed of 10 cm/minute while a load is applied through a needle of 0.2 mm in diameter touched on the surface of the layer. Suitable printing properties such as the printing ink-repelling ability, the printing durability, the sensitivity and the image reproducibility can be obtained when the scratch resistivity of the layer is within such the range. The thickness of the silicone rubber layer usable in the invention is usually from 0.1 to 10 μm, preferably from 0.2 to 5 μm, more preferably from 0.3 to 2 μm.

The light-heat conversion layer and the silicone rubber layer each can be formed by dissolving each the foregoing light-heat conversion composition and the silicone rubber layer composition in a suitable solvent, coating thus obtained solution on the substrate by a coating device such as a wire bar, a spinner or a roller coater, and drying thus coated layer. For example, the followings are usable as the solvent for coating the light-heat conversion layer; a ketone such as methyl ethyl ketone and cyclohexanone, an ester such as butyl acetate, amyl acetate and ethyl propionate, a carbon hydride or a halogenated carbon hydride such as toluene, xylene, monochlorobenzene, carbon tetrachloride, trichloroethylene and trichloroethane, an ether such as methyl cellosolve, ethyl cellosolve and tetrahydrofuran, and polypropylene glycol monomethyl ether acetate, and dimethylformamide are usable. As the solvent for coating the silicone rubber layer, n-hexane, cyclohexane, petroleum ether, and aliphatic carbon hydride solvent Isopar E, H and G, manufactured by Exxon Co., Ltd., and a mixture of these solvents and the foregoing solvents for the light-heat conversion layer.

An adhesion layer may be provided between the light-heat conversion layer and the silicone rubber layer for raising the adhesiveness of the silicone rubber layer to the light-heat conversion layer. For the adhesion layer, one optionally selected from the organic high molecular weight substance described in the description of the light-heat conversion layer and the silicone rubber described in the description of the silicone rubber layer can be used, and a combination of an urethane type organic high molecular weight substance or a condensation type reactive silane compound such as a multi-functional alkoxysilane and a multi-functional acetoxysilane, and a polydimethylsiloxane having a reactive group at the both terminals or in the main chain are preferably used. Concrete examples include Vyron 300, Vyron UR8200, each manufactured by Toyo Boseki Co., Ltd., Primer A, Primer B, Primer C, Primer D, Primer D2 and Primer E, each manufactured by Toray Silicone Co., Ltd., a combination of Takenate A367H and Takenate A-7, a combination of Takenate A-9690 and Takenate A-5, and a combination of Takenate A-968 and Takenate A-8, each manufactured by Takeda Yakuhin Co., Ltd. These adhesion layers is usually coated and dried so that the dry thickness of the layer is within the range of from 0.05 to 10 μm.

Furthermore, various kinds of mold releasing plastic sheet such as a polypropylene sheet, a polyethylene sheet and a mold releasing treated polyethylene terephthalate sheet, mold releasing treated paper, and a sheet of metal such as aluminum, iron and copper may be laminated on the silicone rubber layer to protect the silicone rubber layer, according to necessity. The photosensitive printing plate element comprised of a substrate, the light-heat conversion layer and the silicone rubber layer each provided on the substrate is usually scanned by a light beam condensed to a spot having a diameter of from 5 to 30 μm to ablate the exposed area, the light beam is generated from a semiconductor laser emitting near infrared rays of wavelength of from 680 to 1200 nm. Then the plate is used for printing without any post-treatment. A post-treatment giving a physical impetus may be applied to the plate to remove fine particles of the light-heat conversion layer or that of the silicone rubber layer which is formed by the ablation and adhered on the printing plate after the exposure. The post-treatment is carried out by a brush, a pad, an ultrasonic wave or a spray while supplying an aqueous liquid or an organic solvent.

Other methods can be utilized for removing the fine particles formed by the ablation. By a method, a cover sheet having the surface having a higheradhesiveness to the fine particle than that to the silicone rubber layer is laminated on the silicone rubber layer of the plate after exposure so that the surface of the silicone rubber is faced to the adhesive surface of the cover sheet, then the cover sheet is peeled off. By another method, a cover sheet transparent for laser light is laminated to the plate surface before exposure in the manner similar to the above-mentioned and the sheet is peeled off after exposure. Examples of the cover sheet include ones composed of a support such as a sheet of polyethylene terephthalate, polypropylene or paper and an adhesive layer such as a layer of silicone rubber, ionomer or vinyl acetate provided on the support.

The light-heat conversion layer is preferably not ink-repellent when the silicone rubber layer is provided. When the invention is applied to a printing plate element for making a printing plate using a moisturizing liquid, it is preferable that the layer containing the particle (A) according to the invention is made hydrophilic, more preferably the layer is made hydrophilic and porous, or a hydrophilic layer is provided on the layer containing the particle (A). The foregoing hydrophilic surface is become the non-image area of the printing plate. Image formation by heat mode laser exposure can be realized by providing a layer having an image forming ability by heat on the hydrophilic layer or by giving an ability of changing to oleophilic by heat to the hydrophilic layer itself.

The printing plate element is described in detail below.

The printing plate element comprises a support (substrate) and one or more component layers. The component layer is preferably a porous layer, more preferably the component layer contains a porous particle. The printing plate element is preferablya planographic printing plate element. Although the variety of the printing plates are usable for CTP use, the use of them is not limited to the CTP use.

The printing plate element includes one in which the light-heat conversion layer has the function of the image recording layer, and one having an image recording layer in addition to the light-heat conversion layer. When the light-heat conversion layer has the function of the image recording layer, it is preferable that the light-heat conversion layer is a hydrophilic layer and the area exposed to light of the light-heat conversion layer is changed to ink-acceptable. When the light-heat conversion layer and the image recording layer are separated layers, the image recording layer may be wholly ink-acceptable or may be a hydrophilic layer which is changeable to ink-acceptable by light exposure. A hydrophilic layer may additionally be provided on the image recording layer.

The image recording layer preferably contains a thermally fusible material.

Examples of material usable in the foregoing hydrophilic layer include the following a to e.

a. Porous Silica or Porous Aluminosilicate Particle

The porous silica is usually produced by a wet-method or a dry-method. By the wet-method, gel formed by neutralizing an aqueous solution of silicate is dried and powdered or sedimented matter by the neutralization is powdered to produce the porous silicate. By the dry-method, silicon tetrachloride is burned together with hydrogen and oxygen to form silica. The porosity and the diameter of the silica particles can be controlled by changing the preparation conditions. One prepared from the gel by the wet-method is particularly preferable as the porous silica particle.

The porous aluminosilicate particle is produced, for example, by the method described in JP O.P.I. No. 10-71764. The aluminosilicate particle is an amorphous complex particle synthesized by a hydrolysis method and principal ingredient thereof is aluminum alkoxide and silicon alkoxide. The ratio of alumina and silica in the particle can be varied within the range of from 1:4 to 4:1. A complex particle composed of three or more ingredients prepared by adding another metal alkoxide at the production process can be used in the invention. The porosity and the diameter of such the particles can also be controlled by changing the production conditions.

The porosity of the particle before dispersion is preferably not less than 1.0 ml/g, more preferably not less than 1.2 ml/g, further preferably within the range of from 1.8 ml/g to 2.5 ml/g, in the volume of fine hole. The fine hole volume closely relates to the moisture holding property of the coated layer. A larger fine hole volume results larger moisture holding ability and contamination in the printed image is difficultly occurred and the moisture amount latitude is made wider. However, the durability of the coated layer is lowered since the fragility of the particle itself is raised when the fine hole volume of the particle exceeds 2.5 ml/g. When the fine hole volume is less than 1.0 ml/g, the resistivity to the contamination of printed image and the width of the moisture amount latitude are become insufficient.

The diameter is preferably substantially not more than 1 μm, more preferably not more than 0.5 μm, in the state of included in the hydrophilic layer (including the case of that the particles are subjected to a dispersing and a crushing process). The presence of a coarse particle causes formation of a sharp projection on the surface of the hydrophilic layer and the ink tends to be remained around the projection so that the contamination at the non-image area is increased.

b. Zeolite Particle

Zeolite is crystalline aluminosilicate which is a porous matter having a regular three dimensional net work structure space with a fine hole diameter of from 0.3 to 1 nm. The chemical formula of natural and synthesized zeolite is as follows.

$$(MI,MII_{1/2})_m(Al_mSi_nO_{2(m+n)}).xH_2O$$

wherein MI and MII are each an exchangeable cation. MI is a cation such as $Li^+$, $Na^+$, $K^+$, $Tl^+$, $Me_4N$ (TMA), $Et_4N$ (TEA), $Pr_4N^+$ (TPA), $C_7H_{15}N_2^+$ and $C_8H_{16}N^+$, and MII is a cation such as $Ca^{2+}$, $Mg^{2+}$, $Ba^{2+}$, $Sr^{2+}$ and $C_8H_{18}N_2^{2+}$. The relation of n and m is n≧m, and the ratio of m/n or Al/Si is not more than 1. The polarity of particle is lager when the Al/Si ratio is larger since the content of the exchangeable cation is larger, accordingly the hydrophilicity of the particle is become higher. The Al/Si ratio is preferably from 0.4 to 1.0, more preferably from 0.8 to 1.0.

The zeolite particle to be used in the invention is preferably a synthesized zeolite, of which Al/Si ratio is stable and the particle diameter distribution is relatively sharp. Examples of such the zeolite include Zeolite A:

$Na_{12}(AL_{12}Si_{12}O_{48}).27H_2O$; Al/Si ratio of 1.0, Zeolite X:

$Na_{86}(AL_{86}Si_{106}O_{384}).264H_2O$; Al/Si ratio of 0.811, and Zeolite Y:

$Na_{56}(AL_{56}Si_{136}O_{384}).250H_2O$; Al/Si ratio of 0.412.

The hydrophilicity of the hydrophilic layer itself is considerably raised by containing the highly hydrophilic porous particle having an Al/Si ratio of from 0.4 to 1.0. As a result, the contamination of the printed image is difficultly occurred and the moisture amount latitude is also spread. The contamination caused by a finger print is also considerably improved. When the Al/Si ratio is less than 0.4, the foregoing improvement effects are lowered. The diameter of such the particle is preferably substantially not more than 1 μm, more preferably not more than 0.5 μm, in the state of included in the hydrophilic layer (including the case of that the particles are subjected to a dispersing and a crushing process). The presence of a coarse particle causes formation of a sharp projection on the surface of the hydrophilic layer and the ink tends to be remained around the projection so that the contamination at the non-image area is increased. The content of the porous particle is preferably from 30 to 95%, more preferably from 50 to 90%, by weight of whole weight of the hydrophilic layer (when the layer contains the particle (A), the weight of the particle (A) is excepted).

c. Metal Oxide Fine Particle of Average Diameter of Not More than 100 nm

A metal oxide sol such as colloidal silica, alumina sol and titania sol is usable as the metal oxide fine particle having an average diameter of not more than 100 nm. The metal oxide particle may have any shape such as sphere-shape, a needle-shape and feather-shape. The average diameter of the particle is preferably from 3 to 100 nm, and plural kinds of metal oxide different each other in the average diameter may be used in combination. The particle may be subjected to a surface treatment. The metal oxide fine particle can be used as a binder utilizing the layer making ability thereof. The metal oxide fine particle is suitable for use in the hydrophilic layer since lowering in the hydrophilicity is smaller compared with the use of an organic binder. Among the above-mentioned particles, colloidal silica is particularly preferred since the colloidal silica shows a high layer forming ability at a relative low drying temperature. In the case of colloidal silica, the binding force is stronger when the particle diameter is smaller. When the diameter exceeds 100 nm, the binding force is considerably lowered and the strength is insufficient for the binder.

In the case that the metal oxide fine particle is used together with the porous silica particles, it is preferable that the fine particle is used in a positively charged state. For example, the use of alumina sol and acidic colloidal silica are preferred. Besides, in the case that the metal oxide fine particle is used together with the porous aluminosilicate particle and/or the zeolite particle, it is preferable that the fine particle is used in a negatively charged state. For example, alkaline colloidal silica is preferably used. When the porous silica particle is used together with the porous aluminosilicate and/or the zeolite particle, for example, colloidal silica given with a stability in a wide range of pH by a surface treatment with Al.

d. Inorganic Particle Having a New Morse's Hardness of not Less Than 5

A non-porous particle of metal oxide such as silica, alumina, titania, zirconia and iron oxide, that of metal carbide such as silicon carbide, a particle of boron nitride and a particle of diamond are usable. It is preferable that the particle has not an acute-angled corner and a particle having a near sphere shaped such as a fused silica particle and a shirasu balloon particle is preferred.

As the indicator of non-porous particle, the specific surface area in BET value is preferably not more than 50 $m^2/g$, more preferably not more than 10 $m^2/g$. It is preferable that the average diameter of the particle is from 1 to 2 times, more preferably from 1.1 to 1.5 times, of the thickness of the hydrophilic layer. The diameter distribution of the particle is preferably sharp, and it is preferable that 60% or more of the whole particles is included within the range of from 0.8 to 1.2 times of the average diameter. Furthermore, it is more preferable that the grain having a diameter of 2 times of the average diameter accounts for not more than 5%.

The thickness of the hydrophilic layer is preferably from 0.2 to 10 μm, more preferably from 0.5 to 5 μm. Accordingly, the average diameter of the particle is preferably 0.2 to 20 μm, more preferably 0.5 to 10 μm.

The content of the inorganic particle having a new Morse's hardness of not less than 5 is preferably from 1 to 50%, more preferably from 3 to 30%, by weight of whole weight of the hydrophilic layer (when the layer contains the particle (A), the weight of the particle (A) is excepted).

e. Stratified Mineral Particle

Usable stratified particles include a clayey mineral such as kaolinite, halloysite, chrysotile, talc, smectite (for example, montmorillonite, beidellite, hectorite, saponite), vermiculite, mica and chlorite, and hydrotalcite, stratiform polysilicate such as kanemite, makatite, iarite, magadiite and kenyaite.

Among them, one having a higher charge density of unit layer has a higher polarity and a higher hydrophilicity. The charge density is preferably not less than 0.25, more preferably not less than 0.6. Examples of stratified mineral having such the charge density include smectite (charge density; 0.25 to 0.6, negative charge), vermiculite (charge density; 0.6 to 0.9, negative charge), mica (charge density not more than 1, negative charge), hydrotalcite (charge density; not more than 2, positive charge), and magadiite (charge density:not more than 1, negative charge). Synthesized fluorinated mica is particularly preferred since one having a stable quality such as the diameter is available. Among the synthesized fluorinated mica, swellable one, particularly freely swellable one, is preferred.

An intercalation compound of the foregoing stratified mineral such as a pillared crystal, one treated with an ion exchange treatment and one surface treated, for example treated by a silane coupling agent, are also usable.

The plane stratified mineral particle is preferably a thin layered particle having an average size (the maximum length of the particle) of not more than 20 μm and an average aspect ratio (maximum length of particle/thickness of particle) of not less than 20. It is particularly preferable that the average diameter not more than 10 μm and the aspect ratio of not less than 50. When the particle size is within the foregoing range, a continuity and softness, which are the characteristic of the thin layer type particle, are given to the coated layer so that the strengthen layer difficultly cracked can be obtained.

When the particle diameter falls without the foregoing range, the surface roughness is undesirably increased and the contamination on the non-image area or the contamination of blanket tends to be occurred. When the aspect ratio is lower than the foregoing range, the softness of the layer becomes insufficient and crack inhibition effect of the particle is decreased. The content of the stratified mineral particle is preferably from 1 to 50%, more preferably from 3 to 30%, by weight of whole weight of the hydrophilic layer (when the layer contains the particle (A), the weight of the particle (A) is excepted).

The foregoing porous particle and the stratified mineral particle are dispersed and crushed, or dispersed and peeled for use. The method from dispersing and crushing or peeling layer can be roughly classified to a dry process and wet process. The process of the dry method is relatively simple since any drying process is not necessary for dispersing and crushing by the dry process. However, the wet method is usually advantageous for dispersing and crushing to a size of submicron order and layer peeling to a thickness of not more than 100 nm.

As the dispersing crushing apparatus for the dry process, a high speed rotation impact severing mill such as annular type inomizer, an air flow crusher such as jet mill, a roller type mill, a dry type medium stirring mill such as ball mill, and a compression severing type crusher such as ongu-mill are usable. As the dispersing crushing apparatus for the wet process, a wet type medium stirring mill such as ball mill and aquamizer and a high speed rotation severing frictional mill such as colloid mill are usable.

The diameter of the porous particle after dispersing and crushing is preferably substantially not more than 1 $\mu$m, more preferably not more than 0.5 $\mu$m. When coarse particles are remained, such the particles may be removed by classification or filtration.

The stratified mineral particle after dispersing and crushing preferably has an average size (the maximum length of particle) of not more than 20 $\mu$m, more preferably not more than 10 $\mu$m, and an average aspect ratio (maximum length of particle/thickness of particle) of not less than 20, more preferably not less than 50. The later-mentioned swelling treatment may be applied before the dispersing and crushing.

Particularly, when the wet dispersing is applied, it is preferable to prepare the coating liquid without drying both of the porous particle and the stratified mineral particle, since the particles dispersed and crushed or dispersed and peeled are often recoagulated by drying. The coating liquid may be concentrated or diluted for controlling the concentration of the solid component in the liquid.

The particle may be treated on the surface thereof by adding a surface treating agent to the dispersing and crushing or the dispersing and peeling process. In the dispersing and crushing or the dispersing and peeling process, another component to be added to the coating liquid may be added to simultaneously disperse. Besides, another component to be added in the coating liquid may be added after the dispersing and crushing or the dispersing and peeling process to disperse again. It is assumed that a mechanochemical reaction is occurred in the dispersing and crushing or the dispersing and peeling process, and the strength of the coated layer is often raised when the other component is simultaneously dispersed.

The swellable synthesized fluorinated mica, which is freely swellable, is can be sufficiently swollen and separated to thin layer of thickness of not more than 10 nm only by mixing and stirring with water, and a stable dispersion can be obtained. Mg-vermiculite can be made swellable by the following ion exchange treatment.

Mg-vermiculite+lithium citrate aq.→Li-vermiculite+magnesium citrate aq.

Furthermore, Li-vermiculite definitely swollen by osmotic pressure can be separated to thin layer having an average thickness of not more than 10 nm by mechanically dispersing and peeling.

An organic binder or additive other than the above-mentioned may also be added into the hydrophilic layer. An organic binder having hydrophilicity is preferably used. Example of such the binder include casein, soybean protein, a chitin, starch, gelatin, arginate, a poly(vinyl alcohol), a silyl-modified poly(vinyl alcohol), a cation-modified poly (vinyl alcohol), a cellulose derivative such as a methyl cellulose, a carboxymethyl cellulose, and a hydroxyethyl cellulose, a poly(ethylene oxide), a poly(propylene oxide), a poly(ethylene glycol), a poly(vinyl ether), a copolymer of styrene/butadiene, a conjugated diene type polymer latex of methyl methacrylate/butadiene copolymer, an aryl type copolymer latex, a vinyl type polymer latex, polyacrylamide and polyvinyl-pyrrolidone.

A cationic resin may be contained in the hydrophilic layer. Examples of the cationic resin include a polyalkyleneamine such as polyethyleneamine, polypropyleneamine and a derivative thereof, an acrylamine having a tertiary amino group or a quaternary ammonium group and a diacrylamine. The cationic resin may be added in a form of fine particle. Example of such the resin is the cationic microgel described in JP O.P.I. No. 6-161101.

Moreover, a cross-linking agent may be added into the hydrophilic layer. Examples of the cross-linking agent include a melamine resin, an isocyanate compound, a isooxazole, an aldehyde, an N-methylol compound, a dioxane derivative, a reactive vinyl compound and a reactive halogenated compound.

An aqueous solution of a silicate may be added into the hydrophilic layer as the binder. An alkali silicate such as sodium silicate, potassium silicate and lithium silicate is preferably used. The $SiO_2/M_2O$ ratio of the silicate is preferably decided so that the pH value of the whole coating liquid after the addition of the silicate is not exceeded to 13 for avoiding the dissolution of the inorganic particle.

An inorganic polymer produced by so-called sol-gel method or an organic-inorganic hybrid polymer may be used as the binder to be added into the hydrophilic layer. Known methods for example, those described in S. Sakka, "Application of Sol-Gel Method", Agune-Syofu Sha, and those described in the literatures referred in this publication are usable for producing the inorganic polymer or the organic-inorganic hybrid polymer.

The foregoing organic composition causes the contamination of printed image when the component is cross-linked for raising the durability and the moisture resistivity since the hydrophilicity of the component is considerably lowered even though the component is the hydrophilic resin. Moreover the organic component causes a possibility of degradation of the moisture holding abilitysince the organic component vitiates the porosity of the hydrophilic layer by blocking the opening of the porous particle or by permeating into the hole of the porous particle. Accordingly the amount of the organic component is preferably small. The content of the organic component is preferably from 0 to 50%, more preferably from 1 to 30%, further preferably from 2 to 20%, by weight of whole weight of the hydrophilic layer (when the mlayer contains the particle (A), the weight of the particle (A) is excepted).

Known materials usually used for substrate of the printing plate can be used for the substrate of the printing plate element according to the invention. For example, a metal plate, a plastic film, a paper sheet laminated with polyolefin, and a complex substrate composed by layering these materials are usable. Although there is no limitation on the thickness of the substrate as long as the plate can be mounted on a printing machine, one having a thickness of from 50 to 500 $\mu$m is suitable for handling.

Examples of the metal plate include a plate of iron, stainless steel and aluminum, and aluminum is preferred according to the specific gravity and the stiffness thereof. The aluminum plate is usually subjected to a degreasing treatment by an alkali, an acid or a solvent to remove oil remained on the surface which is applied in the process of compress expanding and winding the aluminum plate. The degreasing treatment by an alkaline solution is preferable. It preferable to provide a adhesion strengthen treatment or a subbing layer to the surface of the plate on which the layer are coated for raising the adhesiveness between the plate surface and the coated layer. For example, immersion into a liquid containing a coupling agent such as a silicate or a silane coupling agent, or coating the liquid and sufficiently drying after the coating may be applied. An anodizing treatment may be applied as a kind of the adhesion strengthen treatment. The anodizing treatment and the immersion or coating treatment may be applied in combination. An aluminum plate roughened by a known method may also be used.

Examples of the plastic film include a film of poly (ethylene terephthalate), poly(ethylene naphthalate), polyimide, polyamide, polycarbonate, polysulfone, poly (phenylene oxide) and cellulose esters. Poly(ethylene terephthalate) and poly(ethylene naphthalate) are particularly preferred. It is preferable to provide a adhesion strengthen treatment or a subbing layer onto the surface of the plate on which the layer are coated for raising the adhesiveness between the platesurface and the.coated layer. Examples of the adhesion strengthen treatment include treatment by corona discharge, flame or UV irradiation. An example of the subbing layer is a layer containing gelatin or latex.

The complex substrate may be made by laminating ones optionally selected from the foregoing materials. The laminating may be carried out before or after the formation of the hydrophilic layer, or just before mounting to the printing machine.

The image forming procedure of a printing plate element using no moisturizing liquid according to the invention is described below with respect to an example of a printing plate element constituted in the order of the silicone-containing ink-repelling layer, the light-heat conversion layer and the substrate. However, the embodiment of the invention is not limited thereto.

All or a part of the light-heat conversion layer is ablated, or the interface between the silicone-containing layer and the light-heat conversion layer is broken by heat caused by the exposure to light. The silicone-containing layer in the light exposed area can be removed by a relative weak physical force since the silicone-containing layer has been peeled off (in some cases the layer often partially cracked or scattered).

The silicone-containing layer of the exposed area is removed, for example, by wiping away by a cloth immersed with a suitable treating liquid, by brushing with a rotating brush in a suitable treating liquid, or by the contacting and/or releasing force of various rollers of the printing machine at the initial step of printing.

In the case of a printing plate element using a moisturizing liquid, which has the layer containing the particle (A) according to the invention, the image can be formed by the following procedure. However the embodiment of the invention is not limited thereto.

An ink-acceptable material is imagewise adhered on the hydrophilic layer containing the particle (A) by a known ink-jet method to form an image layer. The ink-acceptable material has a water resistivity. The ink-acceptable material may be a hot-melt material or a heat hardenable material or a light hardenable material each is hardened by heat and light, respectively.

Examples of the heat hardenable include a halogenated bisphenol, resorcine, bisphenol F, tetrahydroxyphenylethane, novolak, a polyhydroxy compound, a poly glycol, a glycerin triether, a polyolefin, an epoxized soybean oil, vinylcyclohexene dioxide, a combination of an epoxized soybean oil with an organic acid or its anhydride such as phthalic acid, maleic acid sebacic acid or anhydride thereof, or an organic peroxide compound such as benzoyl peroxide or phthaloid peroxide, a combination of diallyl orthophthalate, diallyl iosphthalate or diallyl cholentate and a combination of one of them with an organic peroxide compound such as benzoyl peroxide or phthaloid peroxide, N-methyl-N'-methyloluronethyl ether, N-methyl-N'-ethyloluronethyl ether, N-methyl-N'-methyloluronmethyl ether, tetramethylolurea, N-methyl-N,N',N'-trimethylolurea, N-ethyl-N,N',N'-trimethylol-urea, N,N'-dietyl-N,N'-dimethylolurea, mono and polymethylolmelamine, p-methylolphenol, phenol, o-methylolphenol, a combination of 2,4-dimethylolphenol or 2,6-dimethylolphenol with formaldehyde, an aniline resin, a xylene resin, an unsaturated polyester resin and a furan resin.

Examples of light hardenable material include an unsaturated polyester composed of, for example, a dibasic acid such as maleic anhydride, fumaric acid, itaconic acid, succinic acid, adipic acid, azelaic acid, sebacic acid, phthalic anhydride, terahydrophthalic anhydride, hexahydrophthalic anhydride, isophthalic acid, terephthalic acid, trimellitic acid anhydride and pyromellitic acid anhydride, and a polyvalent alcohol such as ethylene glycol, propylene glycol, 2,3-butanediol, 1,3-butanediol, neopentyl glycol, 1,4-butanediol, diethylene glycol, dipropylene glycol, triethylene glycol, glycelinetrimethylolpropane, polyethylene glycol and polypropylene glycol; and an acrylate monomer, a methacrylate monomer and a oligomer thereof such as methoxydiethylene glycol methacrylate, methoxytetraethylene glycol methacrylate, methoxydiethylene glycol acrylate, methoxypolyethylene glycol acrylate, methoxypolyethylene glycol methacrylate, 2-hydroxydeodecyl methacrylate, 2-hydroxydodecyl acrylate, triethylene glycol dimethacrylate, diethylene glycol dimethacrylate, ethylene glycol methacrylate, polyethylene glycol dimethacrylatei 1,3-butylene glycol dimethacrylate, 1,4-butylene glycol dimethacrylate, 1,6-hexane glycol dimethacrylate, neopentyl glycol dimethacrylate, dipropylene glycol dimethacrylate, propylene glycol dimethacrylate, 2,2-bis(4-methacryloxydiethoxyphenyl)propane, diethylene glycol diacrylate polyethylene glycol diacrylate, 1,3-butylene glycol diacrylate, 1,6-hexylene glycol diacrylate, neopentyl glycol diacrylate, polypropylene glycol diacrylate, 2,2'-bis (4-acryloxypropyloxyphenyl)propane, 2,2'-bis(4-acryloxydiethoxyphenyl)propane, trimethylolpropane trimethacrylate, trimethylolpropane triacrylate, trimethylolethane triacrylate, trimethylolmethane triacrylate, palm oil aliphatic acid mono ester of trimethylolpropane diacrylate, tetramethylolmethane tetracrylate, dibromoneopentyl glycol dimethacrylate and 2,3-dibromopropyl acrylate. The foregoing light hardenable material is usually used together with a light polymerization initiator. Examples of the initiator include an aromatic ketone such as benzophenone, an acetophenone, a diketone and an acyloxime ester.

An image layer can be formed by contacting an ink-acceptable thermally transferable layer provided on a sheet to the surface of the hydrophilic layer by a know thermal transfer method, and imagewise applying heat from the sheet side by a thermal head or a laser light beam so as to transfer the thermally transferable layer of heated area from the sheet to the hydrophilic layer surface, then the sheet is removed.

An image layer can be formed by coating a photo-hardenable or photo-solvable layer on the hydrophilic layer and, after imagewise exposure, removing the soluble portion by development.

An image layer can be formed by coating a known heat (infrared rays) hardenable or heat (infrared rays) solvable layer on the hydrophilic layer and, after imagewise exposure by a laser, removing the soluble portion by development.

An image layer can also be formed by the procedure that a thermally fusible fine particle having a melting point of approximate 100° C., such as polyethylene wax emulsion, is coated on the hydrophilic layer together with a binder such as a water-soluble binder or colloidal silica, and the thermally fusible fine particles are fused and permeated into the hydrophilic layer by imagewise exposure by a laser light beam to form a image portion. The unexposed portion is removed by washing or solved by a moisturizing liquid on the printing machine.

A material capable of forming a visible image by light exposure may be added into any layer provided on the substrate of the printing plate element according to the invention. A known technique such as that used in a heat sensitive paper can be applied for giving the visible image forming ability.

The printing plate element according to the invention is preferably exposed by near infrared emitting laser. An exposing apparatus usually used for thermal CTP can be applied. The exposure energy is preferably within the range of from 100 to 500 mJ/cm$^2$.

In the above, the printing plate element according to the invention is mainly described. However, the invention can be applied to all image forming element in which an image is formed by imagewise irradiated light such as laser light which is converted to heat. Examples of the image forming element other than the printing plate element include the followings One of the examples is a laser thermal transfer image recording element. In the image recording process using such the recording element is used, a laser thermal transfer ink sheet having a light-heat conversion layer and an ink layer and a laser thermal transfer image receiving sheet having a thermoplastic resin layer and an image receiving layer are piles so that the ink layer of the ink sheet and the image receiving layer of the image receiving sheet are contacted, and the laser light is imagewise irradiated so as to transfer the ink layer to the image receiving layer. then the ink sheet is separated from the image receiving sheet to form the image. In this case, the light-heat conversion particle according to the invention is contained in the light-heat conversion layer of the ink sheet.

Another example is an ablation image forming element having an image forming layer containing a colorant (such as a dye and a colored particle) on a substrate. An image is formed by ablation caused by imagewise laser irradiation. In such the case, the light-heat conversion particle according to the invention may be contained in the image forming layer, or may be contained in a light-heat conversion layer separately provided from the image forming layer.

EXAMPLES

The invention is described in concrete below according to examples. However the embodiment of the invention is not limited thereto.

(Preparation or Particle (A))

The surface of the core particle shown in Tables 1 and 2 was covered with a light-heat conversion material and another material by a drying method using a sand grinder and glass beads. The rotation speed of the disc was 800 r.p.m. The composition the suspension of the covered particle (core particle, covering material and dispersing medium) and the treating time are shown in Tables 1 and 2. After the treatment, the particle (a) was sampled and subjected to SEM observation for evaluating the surface covering ratio. Results are shown in Tables 1 and 2.

Propylene glycol monomethyl ether or purified water was added to the covered particle (A) in the sand grinder and stirred to separate from the glass beads. Thus the particle (a) is recovered in a form of suspension.

TABLE 1

| Covered particle suspension No. | Composition of covered particle suspension: Component | Parts by weight | Dry dispersing time (Minute) | Covered ratio of core particle (%) |
|---|---|---|---|---|
| 1-1 | Core particle: PMMA particle MX220 (Soken Kagaku Co., Ltd. Average diameter: 2 μm) | 60 | 30 | Not less than 80 |
| | Titan Black 13M (Mitsubishi Material Co., Ltd.) | 40 | | |
| | Propylene glycol monomethyl ether acetate | 900 | | |
| | Solid content in suspension: wt-% | 10 | | |
| 1-2 | Core particle: PMMA particle MX220 (Soken Kagaku Co., Ltd. Average diameter: 2 μm) | 70 | 30 | Not less than 80 |
| | Titan Black 13M (Mitsubishi Material Co., Ltd.) | 30 | | |
| | Propylene glycol monomethyl ether acetate | 900 | | |
| | Solid content in suspension: wt-% | 10 | | |
| 1-3 | Core particle: PMMA particle MX220 (Soken Kagaku Co., Ltd. Average diameter: 2 μm) | 60 | 60 | Not less than 80 |
| | Titan Black 12S (Mitsubishi Material Co., Ltd.) | 40 | | |
| | Propylene glycol monomethyl ether acetate | 900 | | |
| | Solid content in suspension: wt-% | 10 | | |
| 1-4 | Core particle: PMMA particle MX220 (Soken Kagaku Co., Ltd. Average diameter: 2 μm) | 70 | 30 | Not less than 80 |
| | Titan Black 13M (Mitsubishi Material Co., Ltd.) | 30 | | |
| | Purified water | 900 | | |
| | Solid content in suspension: wt-% | 10 | | |

TABLE 2

| Covered particle suspension No. | Composition of covered particle suspension: Component | Parts by weight | Dry dispersing time (Minute) | Covered ratio of core particle (%) |
|---|---|---|---|---|
| 1-5 | Core particle: PMMA particle MX220 (Soken Kagaku Co., Ltd. Average diameter: 2 μm) | 70 | 40 | Not less than 80 |
| | Titan Black 12S (Mitsubishi Material Co., Ltd.) | 30 | | |
| | Purified water | 900 | | |
| | Solid content in suspension: wt-% | 10 | | |
| 1-6 | Core particle: PMMA particle MX500 (Soken Kagaku Co., Ltd. Average diameter: 5 μm) | 80 | 30 | Not less than 80 |
| | Titan Black 13M (Mitsubishi Material Co., Ltd.) | 20 | | |
| | Purified water | 900 | | |
| | Solid content in suspension: wt-% | 10 | | |
| 1-7 | Core particle: PMMA particle MX220 (Soken Kagaku Co., Ltd. Average diameter: 2 μm) | 70 | 50 | Not less than 80 |
| | Titan Black 13M (Mitsubishi Material Co., Ltd.) | 20 | | |
| | Alumina AKP-G008 (Sumitomo Kagaku Co., Ltd.) | 10 | | |
| | Purified water | 900 | | |
| | Solid content in suspension: wt-% | 10 | | |
| 1-8 | Core particle: PMMA particle MX500 (Soken Kagaku Co., Ltd. Average diameter: 5 μm) | 70 | 40 | Not less than 80 |
| | Titan Black 13M (Mitsubishi Material Co., Ltd.) | 20 | | |
| | Alumina AKP-G008 (Sumitomo Kagaku Co., Ltd.) | 10 | | |
| | Purified water | 900 | | |
| | Solid content in suspension: wt-% | 10 | | |

Example 1, Comparative Example 1 (Printing Plate Using No Moisturizing Liquid)

Examples 1-1 to 1-6

Light-heat conversion layer coating solutions each containing the particle (A) having the composition shown in Tables 3 and 4 were prepared. Each of the coating liquids was coated on the corona discharge treated surface of a poly(ethylene terephthalate) substrate having a thickness of 0.18 mm by a wire bar and dried for 5 minutes at 80° C. to form a light-heat conversion layer. The coated amount was 1.5 g/m$^2$ after drying.

Comparative Example 1-1

Dispersion having the following composition was prepared and subjected to a pre-dispersion treatment by mixing for 1 hour by a planetary mixer and passing 14 times through three roller mill. The solid composition content was adjusted by the same solvent to 30% by weight. Then the dispersion was subjected to a dispersing treatment for 3 hours by a sand grinder using zirconia beads having a diameter of 1 mm. The solid composition content of the dispersed liquid was adjusted to 10% by weight by the same solvent to prepare a light-heat conversion layer coating liquid. The liquid was coated on the 0.18 mm poly(ethylene terephthalate) substrate and dried in the same manner as in Example 1.

Dispersion

| | |
|---|---|
| Titan Black 13M (manufactured by Mitsubishi Material Co., Ltd.) | 15 parts by weight |
| Nitrocellulose | 35 parts by weight |
| Propylene glycol monomethyl ether acetate | 50 parts by weight |

Comparative Example 1-2

A light-heat conversion layer was provided on the poly (ethylene terephthalate) substrate in the same manner as in Comparative example 1-1 except that the amount of Titan Black and that of nitrocellulose in the dispersion liquid composition were each changed to 20 parts by weight and 30 parts by weight, respectively.

On each of the light-heat conversion layers, the following silicone-containing layer coating liquid was coated and dried for 3 minutes at 100° C. Thus printing plat elements to be used with no moisturizing liquid were prepared. The coated amount was 1.0 g/m$^2$.

Silicone-containing Layer Coating Liquid

| | |
|---|---|
| Polydimethylsiloxane having a hydroxyl group at both terminals of the chain (Mw: 80,000) | 93 g |
| 3-[N-allyl-N(2-aminoethyl)]aminopropyl-trimethoxysilane | 6.3 g |
| Dibutylstannous dilaurylate | 0.7 g |
| Isopar E (Exxon Chemical Co., Ltd.) | 900 g |

Thus prepared printing plate element without using moisturizing liquid was mounted on the drum of a laser exposing apparatus so that the surface of silicone-containing layer was outside and imagewise exposed to 830 nm laser light beam (beam diameter: 6 μm) with a resolution of 4,000 dpi while varying the exposing energy. After exposure, the surface of the silicone-containing layer was wiped by a soft cloth immersed with water to remove the silicone-containing layer remained on the exposed area or scattered by ablation around the exposed area. The sensitivity and the Resolution ability of the palate were evaluated by the following procedure. Results are shown in Tables 3 and 4.

Evaluation of Sensitivity

Printing work was carried out using the above prepared printing plate, a printing machine DAIYA1F-1, coated paper and ink for planographic printing with no moisturizing liquid Aqualess Echo-M magenta, manufactured by Toyo Ink co., Ltd. The lowest exposure energy necessary to obtain a good printed image without scratch was visually judged.

Evaluation of Resolution Ability

The file line printed on the paper corresponding to the exposure energy amount by which the sensitivity was decided was observed by a microscope and the width of the line reproduced with no breaking and the sharpness of the edge of the line.

TABLE 3

| Example/ Comparative example | Covered particle suspension No. | Composition of light-heat conversion layer coating liquid (parts by weight): Amount of covered particle suspension | Nitro-cellulose | Propylene glycol monomethyl ether acetate |
|---|---|---|---|---|
| Example 1-1 | 1-1 | 120 | 8 | 72 |
| Example 1-2 | 1-1 | 140 | 6 | 54 |
| Example 1-3 | 1-2 | 120 | 8 | 72 |
| Example 1-4 | 1-2 | 150 | 5 | 45 |
| Example 1-5 | 1-3 | 100 | 10 | 90 |
| Example 1-6 | 1-3 | 120 | 8 | 72 |
| Comparative example 1-1 | None | | | |
| Comparative example 1-2 | None | | | |

TABLE 4

| Example/ Comparative example | Solid component concentration in coating liquid (wt-%) | Amount of Titan Black in the layer (wt-%) | Sensitivity (mJ/cm$^2$) | Resolution ability: Width of reproduced fine line ($\mu$m) | Resolution ability: Sharpness of fine line |
|---|---|---|---|---|---|
| Example 1-1 | 10 | 24.0 | 300 | 12 | Good |
| Example 1-2 | 10 | 28.0 | 250 | 12 | Good |
| Example 1-3 | 10 | 18.0 | 350 | 12 | Good |
| Example 1-4 | 10 | 22.5 | 300 | 12 | Good |
| Example 1-5 | 1 | 20.0 | 350 | 12 | Good |
| Example 1-6 | 1 | 24.0 | 300 | 12 | Good |
| Comparative example 1-1 | 10 | 30.0 | 450 | 24 | Poor |
| Comparative example 1-2 | 10 | 40.0 | 400 | 18 | Poor a little |

Example 2, Comparative Example 2
(Printing Plate Using Moisturizing Liquid)

Formation of Subbing Layer

A subbing layer composed of two sublayers was formed on the 0.18 mm poly(ethylene terephthalate) substrate.

First Subbing Layer

The surface of the substrate on which subbing layer to be provided was treated by corona discharge, then the first subbing layer having the following composition was coated in the atmosphere of 20° C. and a relative humidity of 55% by a wire bar so that the layer thickness after dried is 0.4 $\mu$m, and dried for 2 minutes at 140° C.

First Subbing Layer Coating Liquid

| | |
|---|---|
| Acryl latex particle (n-butyl acrylate/t-butyl acrylate/ styrene/hydroxyethyl methacrylate = 28/22/25/25) | 36.9 g |
| Surfactant (A) | 0.36 g |
| Hardener (a) | 0.98 g |
| Distilled water to make | 1,000 ml |

Second Subbing Layer

The surface coated with the first subbing layer was treated by corona discharge, and second subbing layer having the following composition was coated by an air-knife under the atmosphere of 35° C. and a relative humidity of 22% so that the layer thickness after dried is 0.1 $\mu$m, and dried for 2 minutes at 140° C.

Second Subbing Layer Coating Liquid

| | |
|---|---|
| Gelatin | 9.6 g |
| Surfactant (A) | 0.4 g |
| Hardener (b) | 0.1 g |
| Distilled water to make | 1,000 ml |

Surfactant (A)

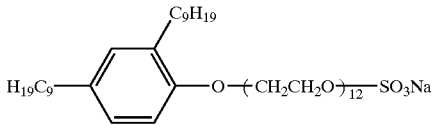

Hardener (a)

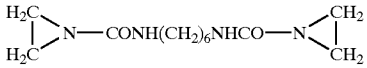

Hardener (b)

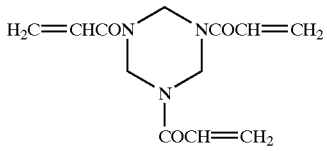

Formation of the Layer Containing the Particle (a) and the Image Forming Layer (1)

Examples 2-1 to 2-9, Comparative Examples 2-1 to 2-8

Light-heat conversion layer coating liquids each containing an aqueous suspension of the particle (A) were prepared according to the composition and preparation manner shown in Tables 5 to 11, and coated on the subbed poly(ethylene terephthalate) by a wire bar so that the coated amount is as shown in Table 12, and dried for 5 minutes at 100° C. In ones having a second layer as described in Table 6, the second layer was coated on the first layer so the coated amount is as shown in Table 12 and dried for 5 minutes at 100° C.

The image forming layer (1) coating liquid having the following composition was coated by a wire bar on the light-heat conversion layer and dried for 3 minutes at 70° C. The coated amount was 1.0 g/m$^2$.

Image Forming Layer (1) Coating Liquid

Ink-acceptable thermally fusible material particle (microcrystalline wax emulsion A206, Gifu Ceramic Co., Ltd., average particle diameter: 0.5 $\mu$m, softening point: 65° C., melting point: 108° C., molten viscosity at 140° C.: 8 cps, solid content: 40% by weight) 100 parts by weight Colloidal silica, Snowtex 20L (Nissan Chemical Industries, Ltd., average particle diameter: 45 nm, solid content 20% by weight) 50 parts by weight Purified Water to Make the Solid Content to 10.0% by Weight Each of thus prepared printing plate elements without using moisturizing liquid was mounted on the drum of a laser exposing apparatus so that the surface of silicone-containing layer was outside and imagewise exposed to 830 rm laser light beam (beam diameter: 6 $\mu$m) with a resolution of 4,000 dpi while varying the exposing energy.

Evaluation of Occurrence of Ablation by Laser Light Exposure

Image area on the printing plate element after exposure was observed by SEM and the lowest energy amount necessary to occur the ablation is determined.

Evaluation of Sensitivity

Printing work was carried out using the above prepared printing plate, a printing machine DAIYA1F-1, coated paper, moisturizing liquid H-liquid SH-51, concentration: 1.5%, manufactured by Tokyo Ink Co., Ltd., and ink for planographic printing with no moisturizing liquid Aqualess Echo-M magenta, manufactured by Toyo Ink co., Ltd. The lowest exposure energy necessary to obtain a good printed image without scratch was visually judged. Results are shown in Table 13.

Evaluation of Resolution Ability

The file line printed on the paper corresponding to the exposure energy amount by which the sensitivity was decided was observed by a microscope and the width of the line reproduced with no breaking and the sharpness of the edge of the line. Results are shown in Table 13.

TABLE 5

| Coating liquid No. | Composition of light-heat conversion layer coating liquid: Composition | Parts by weight | Dispersing method | Titan Black content (wt-%) |
|---|---|---|---|---|
| A | Covered particle suspension 1-4 | 500.0 | Ultrasonic dispersion for 10 minutes after stirring | 15 |
| | Colloidal silica: Snowtex-S (Nissan Chemical Industries, Ltd., average diameter: 8 nm, solid content: 30 wt-%) | 150.0 | | |
| | Poly (vinyl alcohol Z-100 (Nihon Gosei Kagaku Co., Ltd., 10 wt-% aqueous solution) | 45.0 | | |
| | Melamine resin: Sumilase 613 (Sumitomo Kagaku Co., Ltd., 10 wt-% aqueous solution) | 5.0 | | |
| | Reaction accelerator ACX-P (Sumitomo Kagaku Co., Ltd., 10 wt-% aqueous solution) | 0.5 | | |
| | Purified water | 300.0 | | |
| | Solid content in coating liquid: wt-% | 10.0 | | |
| B | Covered particle suspension 1-5 | 600.0 | Ultrasonic dispersion for 10 minutes after stirring | 18 |
| | Colloidal silica: Snowtex-OS (Nissan Chemical Industries, Ltd., average diameter: 8 nm, solid content: 20 wt-%) | 180.0 | | |
| | Poly (vinyl alcohol Z-100 (Nihon Gosei Kagaku Co., Ltd., 10 wt-% aqueous solution) | 36.0 | | |
| | Melamine resin: Sumilase 613 (Sumitomo Kagaku Co., Ltd., 10 wt-% aqueous solution) | 4.0 | | |
| | Reaction accelerator ACX-P (Sumitomo Kagaku Co., Ltd., 10 wt-% aqueous solution) | 0.4 | | |
| | Purified water | 180.0 | | |
| | Solid content in coating liquid: wt-% | 10.0 | | |

TABLE 6

| Coating liquid No. | Composition of light-heat conversion layer coating liquid: Composition | Parts by weight | Dispersing method | Titan Black content (wt-%) |
|---|---|---|---|---|
| C | Covered particle suspension 1-4 | 300.0 | Ultrasonic dispersion for 10 minutes after stirring | 13 |
| | Covered particle suspension 1-6 | 200.0 | | |
| | Colloidal silica: Snowtex-OS (Nissan Chemical Industries, Ltd., average diameter: 8 nm, solid content: 20 wt-%) | 225.0 | | |
| | Poly (vinyl alcohol Z-100 | 45.0 | | |

TABLE 6-continued

| Coating liquid No. | Composition of light-heat conversion layer coating liquid: Composition | Parts by weight | Dispersing method | Titan Black content (wt-%) |
|---|---|---|---|---|
| | (Nihon Gosei Kagaku Co., Ltd., 10 wt-% aqueous solution) | | | |
| | Melamine resin: Sumilase 613 (Sumitomo Kagaku Co., Ltd., 10 wt-% aqueous solution) | 5.0 | | |
| | Reaction accelerator ACX-P (Sumitomo Kagaku Co., Ltd., 10 wt-% aqueous solution) | 0.5 | | |
| | Purified water | 225.0 | | |
| | Solid content in coating liquid: wt-% | 10.0 | | |
| D | Covered particle suspension 1-7 | 400.0 | Ultrasonic dispersion for 10 minutes after stirring | 14 |
| | Covered particle suspension 1-8 | 300.0 | | |
| | Colloidal silica: Snowtex-OS (Nissan Chemical Industries, Ltd., average diameter: 8 nm, solid content: 20 wt-%) | 135.0 | | |
| | Poly (vinyl alcohol Z-100 (Nihon Gosei Kagaku Co., Ltd., 10 wt-% aqueous solution) | 27.0 | | |
| | Melamine resin: Sumilase 613 (Sumitomo Kagaku Co., Ltd., 10 wt-% aqueous solution) | 3.0 | | |
| | Reaction accelerator ACX-P (Sumitomo Kagaku Co., Ltd., 10 wt-% aqueous solution) | 0.3 | | |
| | Purified water | 135.0 | | |
| | Solid content in coating liquid: wt-% | 10.0 | | |

TABLE 7

| Coating liquid No. | Composition of light-heat conversion layer coating liquid: Composition | Parts by weight | Dispersing Method | Titan Black content (wt-%) |
|---|---|---|---|---|
| E | Covered particle suspension 1-4 | 500.0 | The components other than the covered particle suspension were dispersed for 60 minutes by sand grinder/Hi-be 20, then the suspension was added and stirred and dispersed by ultrasonic for 10 minutes after mixed by stirring. | 15 |
| | Porous alminosilicate AMT Silica #200B (Mizusawa Kagaku Co., Ltd.) | 25.0 | | |
| | Colloidal silica: Snowtex-S (Nissan Kagaku Co., Ltd., average diameter: 8 nm, solid content: 30 wt-%) | 83.3 | | |
| | Purified water | 391.7 | | |
| | Solid content in coating liquid: wt-% | 10.0 | | |
| F | Covered particle suspension 1-4 | 300.0 | The components other than the covered particle suspension, melamine resin and reaction accelerator were dispersed for 60 minutes by sand grinder/Hi-be 20, then the remained | 15 |
| | Covered particle suspension 1-6 | 300.0 | | |
| | Porous aluminosilicate AMT Silica #200B (Mizusawa Kagaku Co., Ltd.) | 20.0 | | |
| | Colloidal silica: Snowtex-OS (Nissan | 90.0 | | |

TABLE 7-continued

| Coating liquid No. | Composition of light-heat conversion layer coating liquid: Composition | Parts by weight | Dispersing Method | Titan Black content (wt-%) |
|---|---|---|---|---|
| | Chemical Industries, Ltd., average diameter: 8 nm, solid content: 20 wt-%) | | components were added and stirred and dispersed by ultrasonic for 10 minutes after mixed by stirring. | |
| | Poly (vinyl alcohol Z-100 (Nihon Gosei Kagaku Co., Ltd., 10 wt-% aqueous solution) | 18.0 | | |
| | Melamine resin: Sumilase 613 (Sumitomo Kagaku Co., Ltd., 10 wt-% aqueous solution) | 2.0 | | |
| | Reaction accelerator ACX-P (Sumitomo Kagaku Co., Ltd., 10 wt-% aqueous solution) | 0.2 | | |
| | Purified water | 270.0 | | |
| | Solid content in coating liquid: wt-% | 10.0 | | |

TABLE 8

| Coating liquid No. | Composition of light-heat conversion layer coating liquid: Composition | Parts by weight | Dispersing method | Titan Black content (wt-%) |
|---|---|---|---|---|
| G | Titan Black 13M (Mitsubishi Material Co., Ltd.) | 20.0 | The components other than the melamine resin and reaction accelerator were dispersed for 60 minutes by sand grinder/Hi-be 20, then the remained components were added and stirred and dispersed by ultrasonic for 10 minutes after mixed by stirring. | 15 |
| | Colloidal silica: Snowtex-OS (Nissan Chemical Industries, Ltd., average diameter: 8 nm, solid content: 20 wt-%) | 360.0 | | |
| | Poly(vinyl alcohol Z-100 (Nihon Gosei Kagaku Co., Ltd., 10 wt-% aqueous solution) | 72.0 | | |
| | Melamine resin: Sumilase 613 (Sumitomo Kagaku Co., Ltd., 10 wt-% aqueous solution) | 8.0 | | |
| | Reaction accelerator ACX-P (Sumitomo Kagaku Co., Ltd., 10 wt-% aqueous solution) | 0.8 | | |
| | Purified water | 540.0 | | |
| | Solid content in coating liquid: wt -% | 10.0 | | |
| H | Titan Black 13M (Mitsubishi Material Co., | 20.0 | The components other than the melamine resin | 20 |

TABLE 8-continued

| Coating liquid No. | Composition of light-heat conversion layer coating liquid: Composition | Parts by weight | Dispersing method | Titan Black content (wt-%) |
|---|---|---|---|---|
| | Ltd.)8: | | and reaction | |
| | PMMA particle MX500 (Soken Kagaku Co., Ltd., average diameter: 5 μm) | 30.0 | accelerator were dispersed for 60 minutes by sand grinder/Hi-be 20, then the remained components were added and stirred and dispersed by ultrasonic for 10 minutes after mixed by stirring. | |
| | Colloidal silica: Snowtex-OS (Nissan Chemical Industries, Ltd., average diameter: 8 nm, solid content: 20 wt-%) | 225.0 | | |
| | Poly(vinyl alcohol Z-100 (Nihon Gosei Kagaku Co., Ltd., 10 wt-% aqueous solution) | 45.0 | | |
| | Melamine resin: Sumilase 613 (Sumitomo Kagaku Co., Ltd., 10 wt-% aqueous solution) | 5.0 | | |
| | Reaction accelerator ACX-P (Sumitomo Kagaku Co., Ltd., 10 wt-% aqueous solution) | 0.5 | | |
| | Purified water | 675.0 | | |
| | Solid content in coating liquid: wt-% | 10.0 | | |

TABLE 9

| Coating liquid No. | Composition of light-heat conversion layer coating liquid: Composition | Parts by weight | Dispersing method | Titan Black content (wt-%) |
|---|---|---|---|---|
| I | Porous aluminosilicate AMT Silica #200B (Mizusawa Kagaku Co., Ltd.) | 45.0 | The components other than the melamine resin and reaction accelerator were dispersed for 60 minutes by sand grinder/Hi-be 20, then the remained components were added and stirred and dispersed by ultrasonic for 10 minutes after mixed by stirring. | 15 |
| | Titan Black 13M (Mitsubishi Material Co., Ltd.) | 15.0 | | |
| | Colloidal silica: Snowtex-OS (Nissan Chemical Industries, Ltd., average diameter: 8 nm, solid content: 20 wt-%) | 180.0 | | |
| | Poly(vinyl alcohol Z-100 (Nihon Gosei Kagaku Co. Ltd., 10 wt-% aqueous solution) | 36.0 | | |
| | Melamine resin: Sumilase 613 (Sumitomo Kagaku Co., Ltd., 10 wt-% aqueous solution) | 4.0 | | |
| | Reaction | 0.4 | | |

TABLE 9-continued

| Coating liquid No. | Composition of light-heat conversion layer coating liquid: Composition | Parts by weight | Dispersing method | Titan Black content (wt-%) |
|---|---|---|---|---|
| | accelerator ACX-P (Sumitomo Kagaku Co., Ltd., 10 wt-% aqueous solution) | | | |
| | Purified water | 720.0 | | |
| | Solid content in coating liquid: wt-% | 10.0 | | |

TABLE 10

| Coating liquid No. | Composition of light-heat conversion layer coating liquid: Composition | Parts by weight | Dispersing method | Titan Black content (wt-%) |
|---|---|---|---|---|
| J | Porous alumino silicate AMT Silica #200B (Mizusawa Kagaku Co., Ltd.) | 40.0 | The components other than the melamine resin and reaction accelerator were dispersed for 60 minutes by sand grinder/Hi-be 20, then the remained components were added and stirred and dispersed by ultrasonic for 10 minutes after mixed by stirring. | 20 |
| | Titan Black 13M (Mitsubishi Material Co., Ltd.) | 20.0 | | |
| | Colloidal silica: Snowtex-OS (Nissan Chemical Industries, Ltd., average diameter: 8 nm, solid content: 20 wt-%) | 180.0 | | |
| | Poly(vinyl alcohol Z-100 (Nihon Gosei Kagaku Co., Ltd., 10 wt-% aqueous solution) | 36.0 | | |
| | Melamine resin: Sumilase 613 (Sumitomo Kagaku Co., Ltd., 10 wt-% aqueous solution) | 4.0 | | |
| | Reaction accelerator ACX-P (Sumitomo Kagaku Co., Ltd., 10 wt-% aqueous solution) | 0.4 | | |
| | Purified water | 720.0 | | |
| | Solid content in coating liquid: wt-% | 10.0 | | |

TABLE 11

| Coating liquid No. | Composition of light-heat conversion layer coating liquid: Composition | Parts by weight | Dispersing method | Titan Black content (wt-%) |
|---|---|---|---|---|
| K | Porous aluminosilicate AMT Silica #200B (Mizusawa Kagaku Co., Ltd.) | 25.0 | The components other than the melamine resin and reaction accelerator were dispersed for 60 minutes by sand grinder/Hi-be 20, then the remained components were added and stirred and dispersed by ultrasonic for 10 minutes after mixed by stirring. | 15 |
| | Titan Black 13M (Mitsubishi Material Co., Ltd.) | 15.0 | | |
| | PMMA particle MX500 (Soken Kagaku Co., Ltd., average diameter: 5 μm) | 30.0 | | |
| | Colloidal silica: Snowtex-OS (Nissan Chemical Industries, Ltd., average diameter: nm, solid content: 20 wt-%) | 135.0 | | |
| | Poly(vinyl alcohol Z-100 (Nihon Gosei Kagaku Co., Ltd., 10 wt-% aqueous solution) | 27.0 | | |
| | Melamine resin: Sumilase 613 (Sumitomo Kagaku Co., Ltd., 10 wt-% aqueous solution) | 3.0 | | |
| | Reaction accelerator ACX-P (Sumitomo Kagaku Co., Ltd., 10 wt-% aqueous solution) | 0.3 | | |
| | Purified water | 720.0 | | |
| | Solid content in coating liquid: wt-% | 10.0 | | |

TABLE 12

| Example/ Comparative example | First layer (lower layer): Coating liquid No. | First layer: Coated amount ($g/m^2$) | Second layer (upper layer): Coating liquid No. | Second layer: Coated amount ($g/m^2$) | Titan Black content in the layer ($g/m^2$) |
|---|---|---|---|---|---|
| Example 2-1 | A | 2.0 | I | 0.6 | 0.39 |
| Example 2-2 | B | 1.5 | I | 0.6 | 0.36 |
| Example 2-3 | C | 2.0 | I | 0.6 | 0.35 |
| Example 2-4 | D | 2.0 | I | 0.6 | 0.37 |
| Example 2-5 | E | 2.0 | I | 0.6 | 0.39 |
| Example 2-6 | E | 2.0 | None | 0.0 | 0.30 |
| Example 2-7 | F | 2.0 | I | 0.6 | 0.39 |
| Example 2-8 | F | 2.0 | None | 0.0 | 0.30 |
| Example 2-9 | F | 2.5 | None | 0.0 | 0.38 |
| Comparative example 2-1 | G | 2.0 | I | 0.6 | 0.49 |
| Comparative example 2-2 | G | 2.0 | J | 0.6 | 0.52 |
| Comparative example 2-3 | H | 2.0 | J | 0.6 | 0.52 |
| Comparative example 2-4 | I | 3.0 | None | 0.0 | 0.45 |
| Comparative example 2-5 | J | 2.5 | None | 0.0 | 0.50 |
| Comparative example 2-6 | J | 3.0 | None | 0.0 | 0.60 |
| Comparative | K | 3.0 | None | 0.0 | 0.60 |

TABLE 12-continued

| Example/ Comparative example | First layer (lower layer) Coating liquid No. | First layer (lower layer) Coated amount (g/m$^2$) | Second layer (upper layer) Coating liquid No. | Second layer (upper layer) Coated amount (g/m$^2$) | Titan Black content in the layer (g/m$^2$) |
|---|---|---|---|---|---|
| example 2-8 | | | | | |

TABLE 13

| Example/ Comparative example | Sensitivity (mJ/cm$^2$) | Exposure energy necessary for occurring ablation (mJ/cm$^2$) | Resolution ability: Width of reproduced fine line | Resolution ability: Sharpness of fine line |
|---|---|---|---|---|
| Examp1e 2-1 | 150 | 400 | 12 | Good |
| Example 2-2 | 150 | 400 | 12 | Good |
| Example 2-3 | 200 | 400 | 12 | Good |
| Example 2-4 | 150 | 400 | 12 | Good |
| Example 2-5 | 150 | 400 | 12 | Good |
| Example 2-6 | 150 | 400 | 12 | Good |
| Example 2-7 | 150 | 400 | 12 | Good |
| Example 2-8 | 150 | 400 | 12 | Good |
| Example 2-9 | 150 | 400 | 12 | Poor |
| Comparative example 2-1 | 300 | 350 | 12 | Poor a little |
| Comparative example 2-2 | 250 | 300 | 12 | Poor a little |
| Comparative example 2-3 | 300 | 250 | 12 | Poor |
| Comparative example 2-4 | 300 | 350 | 12 | Poor a little |
| Comparative example 2-5 | 250 | 300 | 12 | Poor a little |
| Comparative example 2-6 | 250 | 300 | 12 | Poor a little |
| Comparative example 2-8 | 350 | 250 | 18 | Poor |

Formation of the Layer Containing the Particle (a) and the Image Forming Layer (2)

Examples 3-1 to 3–4, Comparative Examples 3-1 to 3–4

Light-heat conversion layer coating liquids each containing an aqueous suspension of the particle (A) were prepared according to the composition and preparation manner shown in Tables 5 to 11, and coated on the subbed poly(ethylene terephthalate) by a wire bar so that the coated amount is as shown in Table 14, and dried for 5 minutes at 100° C. Moreover, an image forming layer coating liquid (2) was prepared according to the followings and coated on the light-heat conversion layer by a wire bar, and dried for 3 minutes at 70° C. The coated amount was 0.6 g/m$^2$.

Image Forming Layer (2) Coating Liquid

Coating liquid (I) described in Tables 3 to 5 (solid content: 10% by weight) 700 parts by weight Ink-acceptable thermally fusible material particle (microcrystalline wax emulsion A206, Gifu Ceramic Co., Ltd., average particle diameter: 0.5 $\mu$m, softening point: 65° C., melting point: 108° C., molten viscosity at 140 C.: 8 cps, solid content: 40% by weight) 75 parts by weight Purified Water to Make the Solid Content to 10.0% by Weight The obtained plates were each exposed to laser light and images were formed to evaluate the ablation, sensitivity and resolution ability. Furthermore, the scratch resistivity was determined by the following procedure. Results are shown in Table 15.

Method for Determining the Scratch Resistivity

Wearing resistivity testing machine (HEIDEN-18) was used. A stylus having a diameter of 0.1 mm was touched to the non-image area of the printing plate after image forming treatment and slid while the load applied on the stylus was varied stepwise, 50 g, 100 g, 150 g and 200 g. The load necessary to form a scratch which causes a contamination on the printed image is evaluated.

TABLE 14

| Example/ Comparative example | Light-heat conversion layer Coating liquid No. | Light-heat conversion layer Coated amount (g/m$^2$) | Titan Black content in the layer (other than image forming layer) (g/m$^2$) | Sensitivity |
|---|---|---|---|---|
| Comparative example 3-1 | C | 2.0 | 0.26 | 200 |
| Comparative example 3-2 | C | 2.5 | 0.33 | 200 |
| Comparative example 3-3 | D | 2.0 | 0.28 | 150 |
| Comparative example 3-46 | D | 2.5 | 0.35 | 150 |
| Example 3-1 | G | 2.0 | 0.40 | 300 |
| Example 3-2 | G | 3.0 | 0.60 | 300 |
| Example 3-3 | H | 2.0 | 0.40 | 300 |
| Example 3-4 | H | 2.5 | 0.50 | 250 |

TABLE 15

| Example/ Comparative example | Ablation: occurring exposure energy (mJ/cm$^2$) | Resolution ability: Width of reproduced fine line ($\mu$m) | Resolution ability | Load causing contamination caused by scratch (g) |
|---|---|---|---|---|
| Example 3-1 | 400 | 12 | Good | Not contaminated |
| Example 3-2 | 400 | 12 | Good | Not contaminated |
| Example 3-3 | 400 | 12 | Good | Not contaminated |
| Example 3-4 | 400 | 12 | Good | Not contaminated |
| Comparative example 3-1 | 350 | 12 | Poor a little | 100 |
| Comparative example 3-2 | 350 | 12 | Poor a little | 100 |
| Comparative example 3-3 | 250 | 12 | Poor | 150 |
| Comparative example 3-4 | 250 | 12 | Poor | 150 |

According to the invention, an image forming material and a production method thereof are provided, which have a sensitivity, high resolution ability, and a high abrasion resistivity, and contamination caused by scratch is hardly occurred.

Moreover, the moisture resistivity of the component layer can be raised.

Disclosed embodiment can be varied by a skilled person without departing from the spirit and scope of the invention.

What is claimed is:

1. An image forming material comprising a support, and a component layer, wherein the component layer contains a particle comprising an organic particle core covered with a material containing a light-heat conversion material.

2. The image forming material of claim 1 wherein the image forming material is a printing plate material.

3. The image forming material of claim 1 wherein the image forming material is a laser thermal transfer recording material comprising the component layer and an ink layer.

4. The image forming material of claim 1 wherein the image forming material comprises an image forming layer other than the component layer.

5. The image forming material of claim 1 wherein the component layer is an image forming layer.

6. The image forming material of claim 1 wherein the light-heat conversion material is electroconductive.

7. The image forming material of claim 1 wherein the light-heat conversion material is a metal oxide.

8. The image forming material of claim 7 wherein the light-heat conversion material is titanium oxide nitride.

9. The image forming material of claim 1 wherein the core particle has a transmittance of infrared rays at wavelength of 830 nm of 90 to 100% per 1 $\mu$m of core thickness.

10. The image forming material of claim 1 wherein the average diameter of the core is 0.1 to 19 $\mu$m.

11. The image forming material of claim 1 wherein the coverage ratio of the material containing a light-heat conversion material on the core is not less than 20% by area.

12. A light-heat conversion particle comprising an organic particle core, and a material containing light-heat conversion material, wherein the core is covered with the material containing light-heat conversion material.

13. The light-heat conversion particle of claim 12 wherein the light-heat conversion material is electroconductive.

14. The light-heat conversion particle of claim 12 wherein the light-heat conversion material is a metal oxide.

15. The light-heat conversion particle of claim 14 wherein the light-heat conversion material is titanium oxide nitride.

16. The light-heat conversion particle of claim 12 wherein the coverage ratio of the material containing a light-heat conversion material on the core is not less than 20% by area.

17. A method of preparing an image forming material comprising a step of providing a component layer by coating a coating composition, wherein the coating composition contains a particle which comprises an organic particle core covered with a material containing light-heat conversion material, wherein surface of the core is covered with the material containing the light-heat conversion material by means of a dry dispersion or a spray dispersion method.

* * * * *